US012179248B2

(12) United States Patent
Kiefer et al.

(10) Patent No.: US 12,179,248 B2
(45) Date of Patent: Dec. 31, 2024

(54) DEVICES AND METHODS CONFIGURED TO MANIPULATE FRICTION BETWEEN A WORKING PIECE AND A DEEP DRAWING TOOL IN A DEEP DRAWING PROCESS

(71) Applicant: Novelis Inc., Atlanta, GA (US)

(72) Inventors: Winfried Wilhelm Kiefer, Niedersachsen (DE); Julio Malpica, Canton, GA (US); Carlos Nobrega, Woodstock, GA (US); Jaesuk Park, Marietta, GA (US); Courtney Timms, Canton, GA (US)

(73) Assignee: Novelis Inc., Atlanta, GA (US)

( * ) Notice: Subject to any disclaimer, the term of this patent is extended or adjusted under 35 U.S.C. 154(b) by 129 days.

(21) Appl. No.: 17/912,949

(22) PCT Filed: Mar. 22, 2021

(86) PCT No.: PCT/US2021/023399
§ 371 (c)(1),
(2) Date: Sep. 20, 2022

(87) PCT Pub. No.: WO2021/194924
PCT Pub. Date: Sep. 30, 2021

(65) Prior Publication Data

US 2023/0166313 A1 Jun. 1, 2023

Related U.S. Application Data

(60) Provisional application No. 62/993,244, filed on Mar. 23, 2020, provisional application No. 62/993,239, filed on Mar. 23, 2020.

(51) Int. Cl.
*B21D 22/20* (2006.01)
*B21D 22/08* (2006.01)
(Continued)

(52) U.S. Cl.
CPC ..... *B21D 22/201* (2013.01); *B21D 22/08* (2013.01); *B21D 35/008* (2013.01)

(58) Field of Classification Search
CPC .... B21D 22/201; B21D 22/08; B21D 22/286; B21D 37/18
See application file for complete search history.

(56) References Cited

U.S. PATENT DOCUMENTS

2002/0098367 A1* 7/2002 Mori ..... B21D 51/24 428/457
2011/0113845 A1* 5/2011 Bose ..... B21D 37/18 508/110

FOREIGN PATENT DOCUMENTS

EP 0592211 A1 4/1994
EP 1186351 A1 3/2002
(Continued)

OTHER PUBLICATIONS

Marklew, "Vibration-Assisted Forming-the Commercial Breakthrough at Last?" , Machinery and Production Engineering, vol. 127, No. 3276 , Sep. 17, 1975 , pp. 266-269.
(Continued)

*Primary Examiner* — Mohammed S. Alawadi
(74) *Attorney, Agent, or Firm* — Kilpatrick Townsend & Stockton LLP

(57) ABSTRACT

The invention relates to a system for making a metal product, comprising—a lubrication source (225) for applying a first lubricant (235) on a punch side of a sheet metal blank (205);—a controllable current source (250) for applying different amounts of current; and—a punch (215) and a die (220) for drawing the sheet metal blank (205) into a metal product, wherein the controllable current source (250) is electrically coupled to one or more of the punch (215), the die (220), or a contact point for applying current through the first lubricant (235) while the sheet metal blank (205) is
(Continued)

drawn by the punch (215) and the die (220) into the metal product and while the metal product is being ejected from the punch (215). The application further relates to a method for making a metal product with a such system. The invention relates also to a container manufacturing system (700), comprising—a cylindrical ram (720) comprising a ram body (722) and a ram nose on a distal end of the ram body (722), the ram nose engageable with abase of a container preform;—a die (730) comprising an opening concentrically aligned with the cylindrical ram (720), the opening sized and shaped for receiving the container preform in response to the ram nose engaging with the base of the container preform and the cylindrical ram (720) driving the container preform through the die opening; and—an ultrasonic device (740) coupled with the die (730), wherein the ultrasonic device causes the die (730) to vibrate while the cylindrical ram (720) drives the container preform through the die opening. The application further relates to a method for forming an aluminium container with such system and a die (730) for forming an aluminium container.

8 Claims, 10 Drawing Sheets

(51) Int. Cl.

| | |
|---|---|
| ***B21D 22/28*** | (2006.01) |
| ***B21D 35/00*** | (2006.01) |
| ***B21D 37/18*** | (2006.01) |

(56) References Cited

FOREIGN PATENT DOCUMENTS

| | | | |
|---|---|---|---|
| JP | 6462224 | A | 3/1989 |
| JP | 02160124 | A | 6/1990 |
| JP | 11300423 | A | 11/1999 |
| JP | 2002192250 | A | 7/2002 |
| JP | 2005193293 | A | 7/2005 |
| JP | 2005288483 | A | 10/2005 |
| JP | 2007253219 | A | 10/2007 |
| JP | 2008260042 | A | 10/2008 |
| JP | 2014144470 | A | 8/2014 |
| JP | 5950374 | B1 | 6/2016 |
| KR | 20140126968 | A | 11/2014 |
| TR | 201815097 | A2 | 11/2018 |
| WO | 2015025769 | A1 | 2/2015 |
| WO | 2020/076276 | A9 | 4/2020 |

OTHER PUBLICATIONS

PCT/US2021/023399, "International Search Report and Written Opinion", 14 pages.
CA Application No. 3,175, 116, "Office Action", mailed on Nov. 30, 2023, 4 pages.
VN Application No. 1-2022-06252 , "Office Action", Apr. 26, 2024, 4 pages.
JP Application No. 2022-557194, "Notice of Decision to Grant", mailed on Jan. 16, 2024, 6 pages.
EP Application No. 21718403.5 , "Office Action".
JP Application No. 2022-557194 , "Office Action", Aug. 29, 2023, 14 pages.
PCT/US2021/023399 , "International Preliminary Report on Patentability", Mailed Oct. 6, 2022, 11 pages.
EP Application No. 21718403.5, "Intention to Grant", May 8, 2024, 9 pages.
KR Application No. 10-2022-7033123 , "Office Action", Aug. 9, 2024, 9 pages.

* cited by examiner

DEVICES AND METHODS CONFIGURED TO MANIPULATE FRICTION BETWEEN A WORKING PIECE AND A DEEP DRAWING TOOL IN A DEEP DRAWING PROCESS

CROSS-REFERENCE TO RELATED APPLICATIONS

This application claims the benefit of and priority to U.S. Provisional Application No. 62/993,244, filed on Mar. 23, 2020, and U.S. Provisional Application No. 62/993,239, filed on Mar. 23, 2020, which are hereby incorporated by reference in their entireties.

FIELD

The present disclosure relates to metallurgy generally and more specifically to techniques and systems for forming, stamping, drawing, redrawing, and ironing metal sheets into formed metal products and to improved systems and methods for manufacturing aluminum beverage containers.

BACKGROUND

Metal sheets can be stamped or drawn to form the metal sheets into desirable shapes suitable for various applications. A lubricant or forming fluid may be used to reduce friction and control the flow of material during the forming process. The lubricant or forming fluid may be used as a coolant, since the metal may heat during the forming process. A variety of lubricants or forming fluids are available, and different formulations may be suitable for different forming processes or for the resultant formed product. For example, some water-based lubricants may be easy to remove or leave little residue after cleaning but may not provide sufficient lubrication for some forming processes. Conversely, some oil-based lubricants may provide suitable levels of lubrication and good cooling capabilities, but may leave a residue or be difficult to remove from the formed metal surface, limiting their use for some formed products. In high rate manufacturing processes, improper forming can sometimes result in damaged metal products which can jam the forming equipment, resulting in costly down time.

Beverage containers are commonly made using such high rate manufacturing processes. As an example, the process of making conventional beverage containers generally includes making a blank out of metal material, such as aluminum. The blank may be drawn into a shallow cup and redrawn to reduce the diameter and deepen the cup. The cup may be ironed to reduce the wall thickness of the cup by driving the metal material through one or more ironing dies using a punch or ram. Existing ironing dies can create excessive friction between the cup sidewalls and the die, causing the cup walls to tear or otherwise weaken. Additionally, the excessive friction may dislodge metal particulate from the cup, which can build up on the die, leading to frequent die cleaning or replacement.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

In some aspects, methods of making metal products, such as aluminum alloy products, like beverage containers and other products, are disclosed. The disclosed methods can employ a technique where friction between a metal product and stamping or drawing equipment, such as a punch, die, or stamp, are modified to improve the forming operation. In one aspect, an electric current may be applied to or through a lubricant used during a stamping or punching process to modify a friction coefficient between the metal product and the stamping surface. By applying a suitable current to or through the lubricant, the stamping or punching process can be optimized to increase stamping or punching performance and removal or ejection of the formed metal product from the stamping or punching equipment. In another aspect, ultrasonic vibrations can be applied to parts of the stamping or drawing equipment, or the metal product, to modify frictional forces.

An example method of making a metal product comprises applying a first lubricant on a punch side of a sheet metal blank; applying a second lubricant on a die side of the sheet metal blank; drawing the sheet metal blank using a punch and a die to form the sheet metal blank into a metal product while controlling one or both of a first coefficient of friction between the punch side of the sheet metal blank or a second coefficient of friction between the die side of the sheet metal blank and the die such that the first coefficient of friction is greater than the second coefficient of friction; and ejecting the metal product from the die while controlling a third coefficient of friction between the metal product and the punch to be less than the first coefficient of friction. Although application of lubricants onto the surface of a sheet metal blank is noted above, this may include applying the lubricant onto the corresponding surface of the punch or die instead of applying the lubricant directly to the sheet metal blank.

As it may be desirable for the first coefficient of friction to be greater than the second coefficient of friction in a relative sense, controlling the first coefficient of friction may comprise applying a first electric current through the first lubricant or applying the first electric current through the second lubricant. The coefficient of friction between the metal product and the punch may be a useful aspect for minimizing ejection problems, so controlling the third coefficient of friction may comprise applying a second electric current through the first lubricant.

Example magnitudes of the first electric current or the second electric current, or both, may independently be from about 0.01 mA to about 12 A, such as from 0.01 mA to 0.1 mA, from 0.01 mA to 1 mA, from 0.01 mA to 10 mA, from 0.01 mA to 100 mA, from 0.01 mA to 1 A, from 0.01 mA to 10 A, from 0.01 mA to 12 A, from 0.1 mA to 1 mA, from 0.1 mA to 10 mA, from 0.1 mA to 100 mA, from 0.1 mA to 1 A, from 0.1 mA to 10 A, from 0.1 mA to 12 A, from 1 mA to 10 mA, from 1 mA to 100 mA, from 1 mA to 1 A, from 1 mA to 10 A, from 1 mA to 12 A, from 10 mA to 100 mA, from 10 mA to 1 A, from 10 mA to 10 A, from 10 mA to 12 A, from 100 mA to 1 A, from 100 mA to 10 A, from 100 mA to 12 A, from 1 A to 10 A, from 1 A to 12 A, or from 10 A to 12 A. In some cases, the first electric current or the second electric current, but not both, has a magnitude of 0 A. Example voltages for applying the first electric current or the second electric current, or both, independently may be from about 0.05 V to about 6 V, such as from 0.05 V to 0.1 V, from 0.05 V to 0.5 V, from 0.05 V to 1 V, from 0.05 V to 5 V, from 0.05 V to 6 V, from 0.1 V to 0.5 V, from 0.1 V to 1 V, from 0.1 V to 5 V, from 0.1 V to 6 V, from 0.5 V to 1 V, from 0.5 V to 5 V, from 0.5 V to 6 V, from 1 V to 5 V, from 1 V to 6 V, or from 5 V to 6 V.

The first electric current and the second electric current applied to the first lubricant may be applied in any convenient manner. For example, the first electric current may applied between the punch and the die. The first electric current may be applied between the punch and the sheet metal blank. The second electric current may be applied between the punch and the die or between the punch and the metal product. The first electric current may flow from the punch to the die through at least the first lubricant. The first electric current may flow from the die to the punch through at least the first lubricant. The first electric current may flow the punch to the sheet metal blank through at least the first lubricant. The first electric current may flow from the sheet metal blank to the punch through at least the first lubricant. The first electric current may flow from the punch to the die through at least the second lubricant. The first electric current may flow from the die to the punch through at least the second lubricant. The first electric current may flow from the die to the sheet metal blank through at least the second lubricant. The first electric current may flow from the sheet metal blank to the die through at least the second lubricant. The second electric current may flow from the punch to the die through at least the first lubricant. The second electric current may flow from the die to the punch through at least the first lubricant. The second electric current may flow from the punch to the metal product through at least the first lubricant. The second electric current may flow from the metal product to the punch through at least the first lubricant.

A variety of lubricants and lubricant configurations are useful with the disclosed methods. For example, the first lubricant and the second lubricant may be the same lubricant or different lubricants. In some examples, the first lubricant comprises an ionic liquid. In some examples, the first lubricant may comprise or further comprise one or more of an aqueous lubricant, an oil-based lubricant, a wax-based lubricant, a petroleum-based lubricant, synthetic esters, a polyol ester, a polyol-based lubricant, a polyalphaolefin, polyethylene glycol, glamour wax, fluidized paraffin, synthetic paraffin, paraffin oil, mineral oil, white vaseline, palm oil, natural wax, polyethylene wax, hydrogenated castor wax, bees wax, polyisobutylene, polyethylene glycol dioleate, a fatty acid, stearic acid, oleic acid, tall oils, recinoleic acid, palmitic acid, myristic acid, lauric acid, isostearic acid, a nonionic surfactant, an amine, morpholine, diethyl amino ethanolamine, or water. Useful ionic liquids include, but are not limited to, those comprising an imidazolium cation, an ammonium cation, a pyrrolidinium cation, a phosphonium cation, a trihexyl(tetradecyl)phosphonium cation, a tetrafluoroborate anion, a hexafluorophosphate anion, a phosphate anion, a bis(trifluoromethylsulfonyl) amide anion, a bis(oxalate)borate anion, a perfluoroalkylphosphate anion, a 1-n-3-methylimidazolium, a 1-n-2,3-methylimidazolium, a 1-Allyl-3-methylimidazolium, $[C_4C_1IM][PF_6]$, or $[C_2C_1IM][BF_4]$. The second lubricant may comprise one or more of an ionic liquid, such as those described above, an aqueous lubricant, an oil-based lubricant, a wax-based lubricant, a petroleum-based lubricant, or a conductive lubricant. The amount of lubricant applied to the sheet metal blank may be controlled. In some cases, applying the first lubricant comprises establishing a loading of the first lubricant on the punch side of the sheet metal blank of from 0.1 $g/m^2$ to 1 $g/m^2$. In some cases, applying the second lubricant comprises establishing a loading of the second lubricant on the die side of the sheet metal blank of from 0.1 $g/m^2$ to 1 $g/m^2$.

As noted above, the coefficient of friction between the punch and the sheet metal blank or the metal product and between the die and the sheet metal blank may be controlled. Example coefficient of friction may correspond to or be determined as a standard coefficient of friction. Example standard coefficients of friction for between the sheet metal blank and/or the punch may independently be from about 0.02 to about 0.27, such as from 0.02 to 0.04, from 0.02 to 0.06, from 0.02 to 0.08, from 0.02 to 0.1, from 0.02 to 0.12, from 0.02 to 0.14, from 0.02 to 0.16, from 0.02 to 0.18, from 0.02 to 0.2, from 0.02 to 0.22, from 0.02 to 0.24, from 0.02 to 0.26, from 0.02 to 0.27, from 0.04 to 0.06, from 0.04 to 0.08, from 0.04 to 0.1, from 0.04 to 0.12, from 0.04 to 0.14, from 0.04 to 0.16, from 0.04 to 0.18, from 0.04 to 0.2, from 0.04 to 0.22, from 0.04 to 0.24, from 0.04 to 0.26, from 0.04 to 0.27, from 0.06 to 0.08, from 0.06 to 0.1, from 0.06 to 0.12, from 0.06 to 0.14, from 0.06 to 0.16, from 0.06 to 0.18, from 0.06 to 0.2, from 0.06 to 0.22, from 0.06 to 0.24, from 0.06 to 0.26, from 0.06 to 0.27, from 0.08 to 0.1, from 0.08 to 0.12, from 0.08 to 0.14, from 0.08 to 0.16, from 0.08 to 0.18, from 0.08 to 0.2, from 0.08 to 0.22, from 0.08 to 0.24, from 0.08 to 0.26, from 0.08 to 0.27, from 0.1 to 0.12, from 0.1 to 0.14, from 0.1 to 0.16, from 0.1 to 0.18, from 0.1 to 0.2, from 0.1 to 0.22, from 0.1 to 0.24, from 0.1 to 0.26, from 0.1 to 0.27, from 0.12 to 0.14, from 0.12 to 0.16, from 0.12 to 0.18, from 0.12 to 0.2, from 0.12 to 0.22, from 0.12 to 0.24, from 0.12 to 0.26, from 0.12 to 0.27, from 0.14 to 0.16, from 0.14 to 0.18, from 0.14 to 0.2, from 0.14 to 0.22, from 0.14 to 0.24, from 0.14 to 0.26, from 0.14 to 0.27, from 0.16 to 0.18, from 0.16 to 0.2, from 0.16 to 0.22, from 0.16 to 0.24, from 0.16 to 0.26, from 0.16 to 0.27, from 0.18 to 0.2, from 0.18 to 0.22, from 0.18 to 0.24, from 0.18 to 0.26, from 0.18 to 0.27, from 0.2 to 0.22, from 0.2 to 0.24, from 0.2 to 0.26, from 0.2 to 0.27, from 0.22 to 0.24, from 0.22 to 0.26, from 0.22 to 0.27, from 0.24 to 0.26, from 0.24 to 0.27, or from 0.26 to 0.27. The friction coefficient may be controlled, in some cases, by application of current. The application of current may also modify properties of the lubricants. For example, the current may adjust a viscosity of the lubricant, in some cases. The first lubricant or the second lubricant may independently exhibit a viscosity of from about 2.5 mPas to about 190 mPas during the drawing, such as from 2.5 mPas to 5 mPas, from 2.5 mPas to 10 mPas, from 2.5 mPas to 50 mPas, from 2.5 mPas to 100 mPas, from 2.5 mPas to 150 mPas, from 2.5 mPas to 190 mPas, from 5 mPas to 10 mPas, from 5 mPas to 50 mPas, from 5 mPas to 100 mPas, from 5 mPas to 150 mPas, from 5 mPas to 190 mPas, from 10 mPas to 50 mPas, from 10 mPas to 100 mPas, from 10 mPas to 150 mPas, from 10 mPas to 190 mPas, from 50 mPas to 100 mPas, from 50 mPas to 150 mPas, from 50 mPas to 190 mPas, from 100 mPas to 150 mPas, from 100 mPas to 190 mPas, or from 150 mPas to 190 mPas.

The methods described herein may be useful with a variety of metals and a variety of stamping or drawing operations. In some cases, the sheet metal blank comprises an aluminum alloy, such as a 3xxx series aluminum alloy, an AA3003 alloy, an AA3004 alloy, an AA3104 alloy, or an AA3105 alloy. The punch or the die may comprise steel. The metal product may optionally comprise a metal cup, a redrawn metal cup, or a metal bottle preform.

Systems are also disclosed herein. In some cases, the disclosed systems may be useful for performing at least a part of the disclosed methods. An example system for making a metal product comprises a lubrication source for applying a first lubricant on a punch side of a sheet metal blank; a controllable current source for applying different amounts of current; and a punch and a die for drawing the sheet metal blank into a metal product. The controllable current source may be electrically coupled to one or more of the punch, the die, or a contact point for applying current through the first lubricant while the sheet metal blank is drawn by the punch and the die into the metal product. The controllable current source may be electrically coupled to one or more of the punch, the die, or a contact point for applying current through the first lubricant while the metal product is being ejected from the punch. Optionally, the controllable current source is configured to apply a first current through the first lubricant during drawing of the sheet metal blank and to apply a second current through the first lubricant during ejection of the metal product.

The disclosed techniques employing control over friction can be useful in manufacturing aluminum beverage containers, as well as other aluminum products. In some aspects, systems and methods for forming an aluminum beverage container using ultrasonic vibrations are disclosed, such as with or without controlling friction as described above by application of electric current to or through a lubricant, but where the friction can be controlled by application of ultrasonic vibration to the metal product or the stamping or drawing equipment.

Various examples utilize a die for receiving a container preform. The walls and base of the container preform may be engaged with one end of a ram, also referred to in some cases as a punch. The ram and a container preform or other metal product, such as a sheet metal blank, may be aligned with an opening in the die and the ram may drive the container preform through the die opening along a linear path. The die may be vibrated by an ultrasonic device, for example as the container preform is driven through the opening, reducing the friction between the walls of the container preform and the opening in the die. The die may be vibrated at different frequencies and/or in different directions to reduce friction and/or prevent metal buildup on the die.

According to various examples, a container manufacturing system is provided. The container manufacturing system may include a ram, a die, and an ultrasonic device. The ram may be cylindrical and include a ram body and a ram nose on the distal end of the ram body. The ram nose may engage with a base of a container preform. The die may have an opening concentrically aligned with the ram. The die opening may be sized and shaped for receiving the container preform in response to the ram nose engaging with the base of the container preform and driving the container preform through the die opening. The ultrasonic device may be coupled with the die and cause the die to vibrate while the ram drives the container preform through the die opening.

According to various examples, a method of forming an aluminum beverage container is provided. The method may include receiving a container preform on a ram. The container preform may include a base coupled with sidewalls. The base may be engaged with a distal end of the ram. The method may include vibrating a die using an ultrasonic device connected to the die. The die may include an opening concentrically aligned with the ram and may be sized and shaped for receiving the container preform. The method may further include driving the container preform through the die opening with the ram by moving the ram in a linear direction through the die opening.

According to various examples, a die for forming an aluminum beverage container is provided. The die includes a body defining an opening sized and shaped for receiving a container preform in response to the container preform being driven by a ram through the die opening. An ultrasonic device may be coupled with the die, vibrating the die while the container preform is being driven through the die opening by the ram.

Other objects and advantages will be apparent from the following detailed description of non-limiting examples.

BRIEF DESCRIPTION OF THE FIGURES

The specification makes reference to the following appended figures, in which use of like reference numerals in different figures is intended to illustrate like or analogous components.

DETAILED DESCRIPTION

Figure 1A:
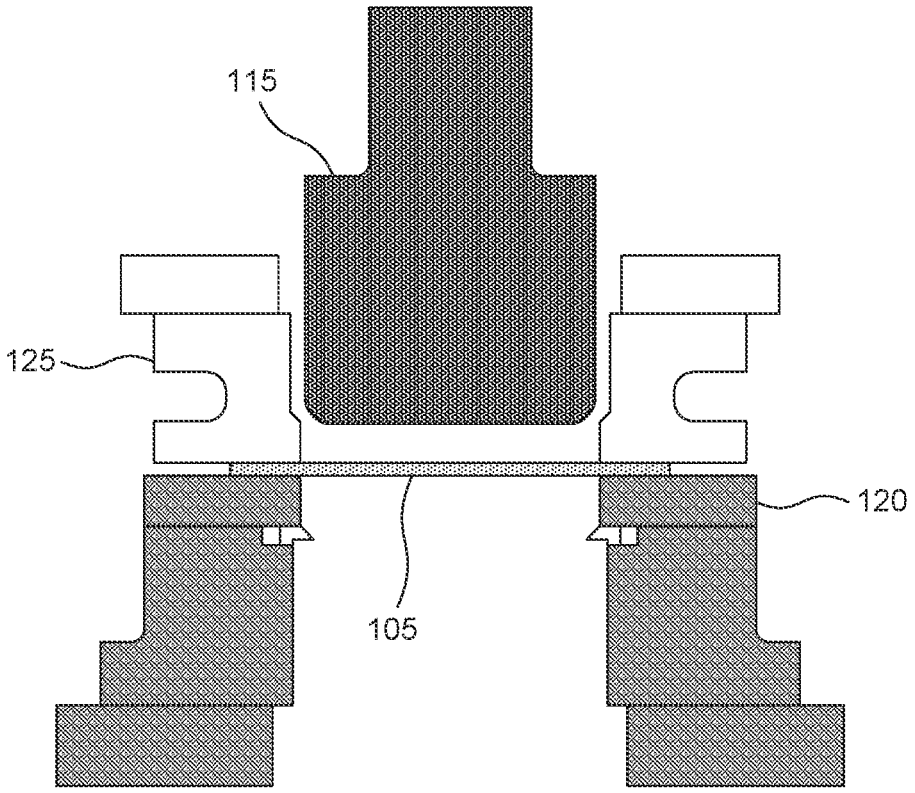
FIG. 1A and FIG. 1B provide schematic illustrations showing drawing of a metal sheet using a punch and die.

Described herein are techniques for improving the reliability of metal forming operations, such as stamping, drawing, redrawing, or ironing processes. In some cases, the disclosed techniques employ lubricants that can have their lubricating properties changed in real time, allowing for better and more precise control over forming operations, which may, in turn, reduce or limit the rate at which forming failures occur. In some cases, the disclosed techniques employ ultrasonic vibrations, such as to change frictional forces at a die during forming operations.

As an example, during the forming of a metal product from a metal sheet, the friction between the forming equipment (e.g., a punch and die or a stamp and die) and the sheet metal or a metal preform can be adjusted through use of a lubricant that can have its properties dynamically controlled through application of an electric current and/or voltage. As another example, the friction between the forming equipment and the sheet metal or a metal preform can be adjusted through application of ultrasonic vibrations to the forming equipment or the sheet metal or metal preform to dynamically control friction. As one example, it may be desirable to have a relatively high amount of friction between the forming equipment and the sheet metal blank or preform during a drawing or stamping process and also to have a relatively low amount of friction between the formed sheet metal product and the drawing or stamping equipment after the drawing or stamping is complete and during ejection or removal of the drawn sheet metal product from the forming equipment.

Figure 1B:
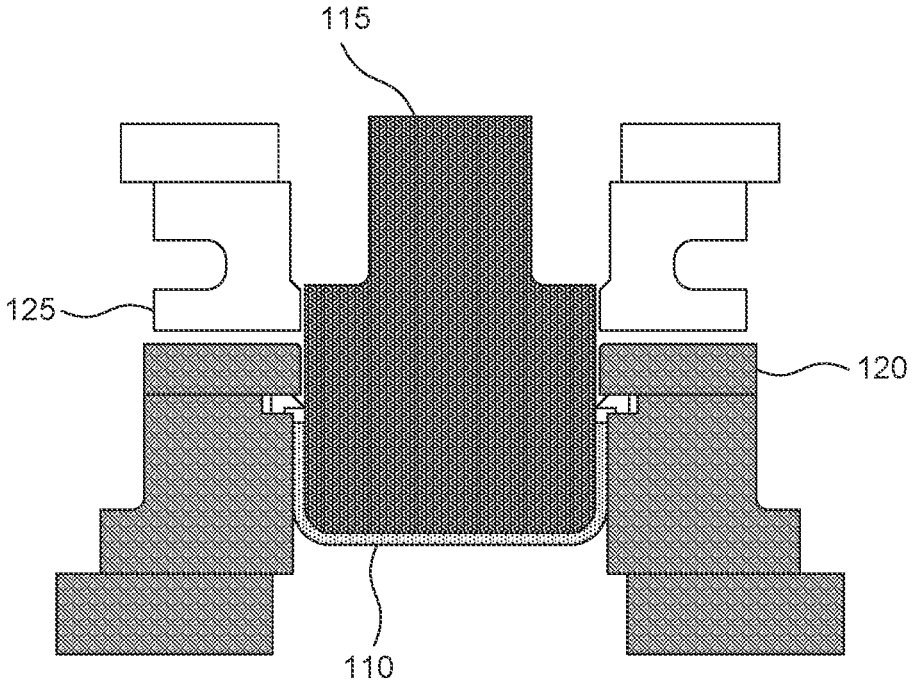

FIG. 1A and FIG. 1B provide schematic cross-sectional illustrations showing a sheet metal blank 105 being drawn into a metal cup 110 using a punch 115 and die 120. In some cases, metal cup 110 may be referred to as a preform. As shown in FIG. 1A, prior to drawing, sheet metal blank 105 is held in place by die 120 and a blankholder 125. During forming, punch 115 is moved in a downward direction and into an opening in die 120, forming the sheet metal blank 105 into metal cup 110, as shown in FIG. 1B. In some cases, punch 115 may be mounted on a ram and may optionally be referred to as a ram. Following completion of forming of metal cup 110, punch 115 may be moved upward and metal cup 110 ejected downward, such as by injecting compressed gas between metal cup 110 and punch 115.

In some cases, however, the drawing or ejection processes may not operate as reliably as are desirable, which can result in interruption to a manufacturing process. For example, if the friction forces on the punch side surface of sheet metal blank 105 and the die side surface of sheet metal blank 105 are not correctly balanced, sheet metal blank 105 may be destroyed, damaged, or may be improperly drawn. As another example, if the friction force on the punch side surface of metal cup 110 is too high, metal cup 110 may not be properly ejected and damage to metal cup 110 may occur. If damage to sheet metal blank 105 or metal cup 110 occurs, this may result in interruption to the drawing operation and subsequent manufacturing processes, which may be normally taking place on a short time scale and in repeated succession (e.g., drawing 50 or more cups per minute). Additionally, time consuming operations involving disassembly of die 120 and removal of damaged sheet metal may be incurred, further slowing the restart of manufacturing. By controlling the friction between the forming equipment and the metal being formed, the forming operation can be optimized, reducing or minimizing damage to the formed metal product and associated interruptions to the forming process. In some examples, the formed metal cup 110 may be a beverage container or a beverage container preform.

Definitions and Descriptions

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "3xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, a plate generally has a thickness of greater than about 15 mm. For example, a plate may refer to an aluminum product having a thickness of greater than about 15 mm, greater than about 20 mm, greater than about 25 mm, greater than about 30 mm, greater than about 35 mm, greater than about 40 mm, greater than about 45 mm, greater than about 50 mm, or greater than about 100 mm.

As used herein, a shate (also referred to as a sheet plate) generally has a thickness of from about 4 mm to about 15 mm. For example, a shate may have a thickness of about 4 mm, about 5 mm, about 6 mm, about 7 mm, about 8 mm, about 9 mm, about 10 mm, about 11 mm, about 12 mm, about 13 mm, about 14 mm, or about 15 mm.

As used herein, a sheet generally refers to an aluminum product having a thickness of less than about 4 mm. For example, a sheet may have a thickness of less than about 4 mm, less than about 3 mm, less than about 2 mm, less than about 1 mm, less than about 0.5 mm, or less than about 0.3 mm (e.g., about 0.2 mm).

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10. Unless stated otherwise, the expression "up to" when referring to the compositional amount of an element means that element is optional and includes a zero percent composition of that particular element. Unless stated otherwise, all compositional percentages are in weight percent (wt. %).

As used herein, the meaning of "a," "an," and "the" includes singular and plural references unless the context clearly dictates otherwise.

Methods of Treating and Forming Metal Products

Described herein are methods of treating metals and metal alloys, including aluminum, aluminum alloys, magnesium, magnesium alloys, magnesium composites, and steel, among others, and the resultant metal and metal alloy products. In some examples, the metals for use in the methods described herein include aluminum alloys, for example, 1xxx series aluminum alloys, 2xxx series aluminum alloys, 3xxx series aluminum alloys, 4xxx series aluminum alloys, 5xxx series aluminum alloys, 6xxx series aluminum alloys, 7xxx series aluminum alloys, or 8xxx series aluminum alloys. In some examples, the materials for use in the methods described herein include non-ferrous materials, including aluminum, aluminum alloys, magnesium, magnesium-based materials, magnesium alloys, magnesium composites, titanium, titanium-based materials, titanium alloys, copper, copper-based materials, composites, sheets used in composites, or any other suitable metal, non-metal or combination of materials. Monolithic as well as non-monolithic, such as roll-bonded materials, cladded alloys, clad layers, or various other materials are also useful with the methods described herein. In some examples, aluminum alloys containing iron are useful with the methods described herein.

By way of non-limiting example, exemplary 1xxx series aluminum alloys for use in the methods described herein can include AA1100, AA1100A, AA1200, AA1200A, AA1300, AA1110, AA1120, AA1230, AA1230A, AA1235, AA1435, AA1145, AA1345, AA1445, AA1150, AA1350, AA1350A, AA1450, AA1370, AA1275, AA1185, AA1285, AA1385, AA1188, AA1190, AA1290, AA1193, AA1198, or AA1199.

Non-limiting exemplary 2xxx series aluminum alloys for use in the methods described herein can include AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2024, AA2024A, AA2124, AA2224, AA2224A, AA2324, AA2424, AA2524, AA2624, AA2724, AA2824, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, or AA2199.

Non-limiting exemplary 3xxx series aluminum alloys for use in the methods described herein can include AA3002, AA3102, AA3003, AA3103, AA3103A, AA3103B, AA3203, AA3403, AA3004, AA3004A, AA3104, AA3204, AA3304, AA3005, AA3005A, AA3105, AA3105A, AA3105B, AA3007, AA3107, AA3207, AA3207A, AA3307, AA3009, AA3010, AA3110, AA3011, AA3012, AA3012A, AA3013, AA3014, AA3015, AA3016, AA3017, AA3019, AA3020, AA3021, AA3025, AA3026, AA3030, AA3130, or AA3065.

Non-limiting exemplary 4xxx series aluminum alloys for use in the methods described herein can include AA4004, AA4104, AA4006, AA4007, AA4008, AA4009, AA4010, AA4013, AA4014, AA4015, AA4015A, AA4115, AA4016, AA4017, AA4018, AA4019, AA4020, AA4021, AA4026, AA4032, AA4043, AA4043A, AA4143, AA4343, AA4643, AA4943, AA4044, AA4045, AA4145, AA4145A, AA4046, AA4047, AA4047A, or AA4147.

Non-limiting exemplary 5xxx series aluminum alloys for use in the methods described herein product can include AA5182, AA5183, AA5005, AA5005A, AA5205, AA5305, AA5505, AA5605, AA5006, AA5106, AA5010, AA5110, AA5110A, AA5210, AA5310, AA5016, AA5017, AA5018, AA5018A, AA5019, AA5019A, AA5119, AA5119A, AA5021, AA5022, AA5023, AA5024, AA5026, AA5027, AA5028, AA5040, AA5140, AA5041, AA5042, AA5043, AA5049, AA5149, AA5249, AA5349, AA5449, AA5449A, AA5050, AA5050A, AA5050C, AA5150, AA5051, AA5051A, AA5151, AA5251, AA5251A, AA5351, AA5451, AA5052, AA5252, AA5352, AA5154, AA5154A, AA5154B, AA5154C, AA5254, AA5354, AA5454, AA5554, AA5654, AA5654A, AA5754, AA5854, AA5954, AA5056, AA5356, AA5356A, AA5456, AA5456A, AA5456B, AA5556, AA5556A, AA5556B, AA5556C, AA5257, AA5457, AA5557, AA5657, AA5058, AA5059, AA5070, AA5180, AA5180A, AA5082, AA5182, AA5083, AA5183, AA5183A, AA5283, AA5283A, AA5283B, AA5383, AA5483, AA5086, AA5186, AA5087, AA5187, or AA5088.

Non-limiting exemplary 6xxx series aluminum alloys for use in the methods described herein can include AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, or AA6092.

Non-limiting exemplary 7xxx series aluminum alloys for use in the methods described herein can include AA7011, AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046, AA7046A, AA7003, AA7004, AA7005, AA7009, AA7010, AA7011, AA7012, AA7014, AA7016, AA7116, AA7122, AA7023, AA7026, AA7029, AA7129, AA7229, AA7032, AA7033, AA7034, AA7036, AA7136, AA7037, AA7040, AA7140, AA7041, AA7049, AA7049A, AA7149, 7204, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, or AA7099.

Non-limiting exemplary 8xxx series aluminum alloys for use in the methods described herein can include AA8005, AA8006, AA8007, AA8008, AA8010, AA8011, AA8011A, AA8111, AA8211, AA8112, AA8014, AA8015, AA8016, AA8017, AA8018, AA8019, AA8021, AA8021A, AA8021B, AA8022, AA8023, AA8024, AA8025, AA8026, AA8030, AA8130, AA8040, AA8050, AA8150, AA8076, AA8076A, AA8176, AA8077, AA8177, AA8079, AA8090, AA8091, or AA8093.

The metals described herein can be cast using any suitable casting method. As a few non-limiting examples, the casting process can include direct chill casting (including direct chill co-casting), semi-continuous casting, continuous casting (including, for example, by use of a twin belt caster, a twin roll caster, a block caster, or any other continuous caster), electromagnetic casting, hot top casting, or any other casting method. Cast metals may be in the form of cast ingots, cast slabs, cast billets, or other cast products. Cast products can be processed by any suitable means. Such processing steps include, but are not limited to, homogenization, hot rolling, cold rolling, solution heat treatment, and an optional pre-aging step. In some examples, cast metal products can be processed to form rolled metal products, such as metal sheets, metal shates, or metal plates. Metal sheets, for example, may be provided as a rolled coil of sheet metal, and may be sectioned or punched to form a metal blank. Rolled metal products may be subjected to additional forming processes (e.g., stamping, drawing, ironing, or the like) to shape the material into a particular orientation or profile for a target application.

The disclosed methods include processes of forming a metal or metal alloy into a formed metal or metal alloy product. Specific reference to forming processes involving sheet metal are described below, but other metal products, such as metal shates or metal plates, may also be subjected to forming processes.

During forming of metal sheets, friction between a metal sheet and the forming equipment, such as stamping equipment or drawing equipment, can impact how the metal comprising the metal sheet will flow. As an example, if the friction is not properly distributed, the metal may not form as desired, resulting in excess or insufficient flow of material in various directions. For example, if the friction is too large for a particular forming operation, the metal can fracture or tear due to the forces that are generated during forming, resulting in an opening, crack, or separation within the metal product. If the friction is too small for a particular forming operation, the metal could be partially or completely ejected from the forming equipment in an undesirable way.

To control friction, lubricants can be placed between the metal sheet and the forming equipment. Lubricants may also be used as coolants during some forming processes, as the forming process itself can generate heat. In some cases, lubrication is used over an entire surface of a metal sheet during a forming process. In other cases, only portions of a metal sheet receive lubrication. Different lubricants may be used to establish different friction coefficients between a metal sheet and the forming equipment, but generally the friction coefficient under conventional operations does not change unless there is a change in the amount or type of lubricant used. For some operations, however, it is desirable to change the friction coefficient in real time without having to change the amount or type of lubricant. In some cases, the disclosed systems and methods may employ a lubricant that changes properties by application of an electric voltage and/or current, such as to allow for control over the friction coefficient between two components. In some cases, the disclosed systems and methods may employ application of ultrasonic vibrations to allow for control over the friction coefficient between two components.

For example, in some processes, it may be desirable to control the friction coefficient between forming equipment and a metal product during and after a forming operation. Use of an electrically controllable lubricant or ultrasonic vibrations can allow the friction coefficient between a metal product and forming equipment to change, such as to allow for one friction coefficient to be used during forming and another friction coefficient to be used during removal of the metal product from the forming equipment.

Figure 2:
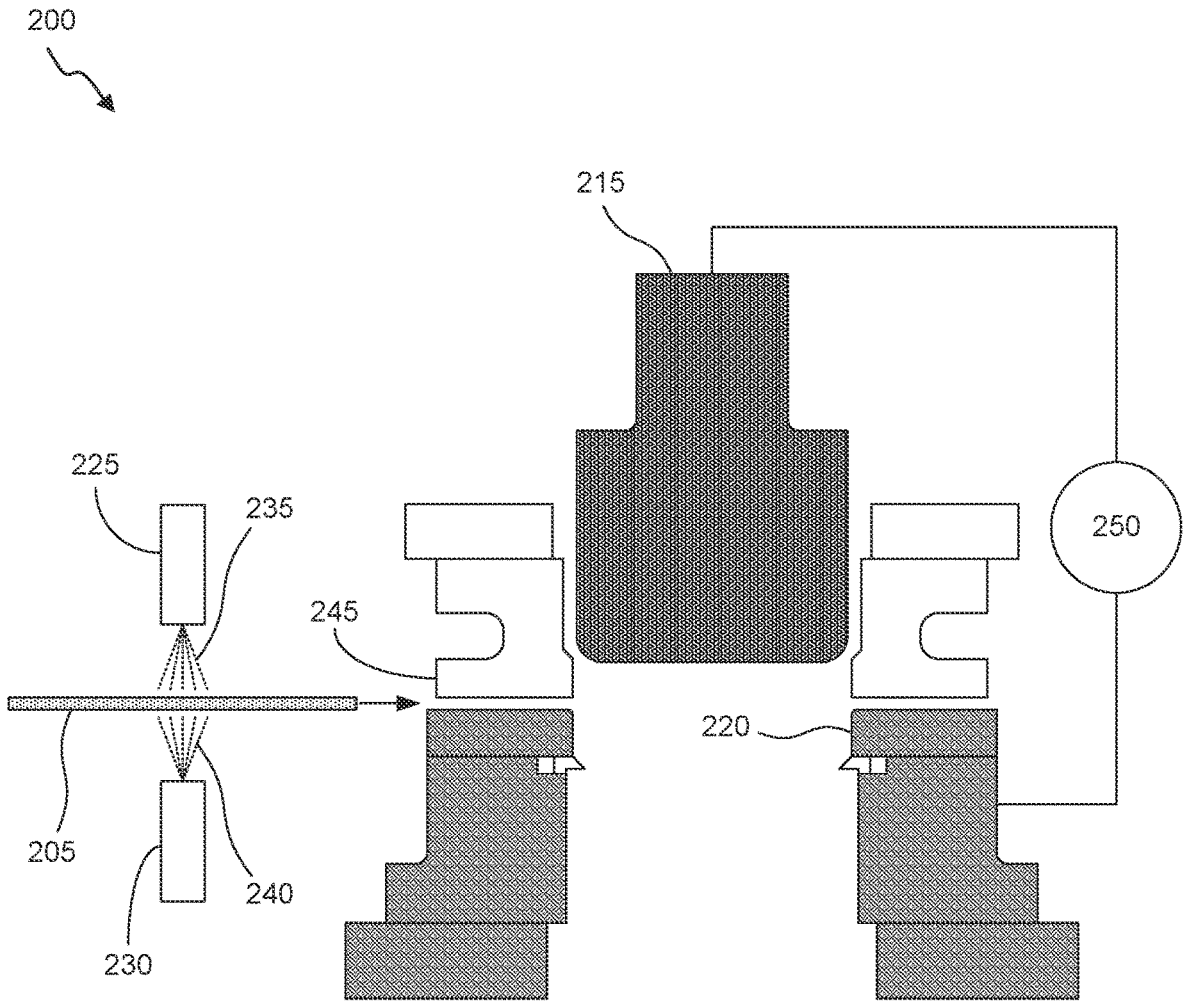
FIG. 2 provides a schematic illustration showing a system for forming a metal sheet.

FIG. 2 provides a schematic illustration of an example forming system 200 allowing for control over friction coefficients at various processing times. Although forming system 200 is depicted as equipment for subjecting a metal sheet 205, such as a metal blank, to a deep drawing process, other forming process can be used, such as stamping, roll forming, bending, hemming, or the like. Forming system 200 comprises a punch 215, a die 220, a first lubrication source 225, a second lubrication source 230, a blankholder 245, and a current source 250. First lubrication source 225 and second lubrication source 230 may comprise any suitable equipment for applying a first lubricant 235 and a second lubricant 240, respectively, to metal sheet 205. For purposes of illustration, first lubrication source 225 and second lubrication source 230 are depicted as comprising spray nozzles for applying first lubricant 235 to a punch side surface of metal sheet 205 and second lubricant 240 to a die side surface of metal sheet 205.

Current source 250 can be electrically coupled to one or more of punch 215, die 220, or another contact point for applying electric current to or through the first lubricant 235 and/or the second lubricant 240 that is applied to surfaces of metal sheet 205 at various stages of a forming operation in order to modify the lubricant properties and adjust friction. Current source 250 may provide a voltage between punch 215 and die 220 to allow for a current to pass through first lubricant 235, metal sheet 205, and second lubricant 240. The direction of current flow may be alterable, and the current may flow in a forward direction or a reverse direction, depending on the voltage applied. Forward and reverse currents may provide advantages for some configurations or for adjusting a friction coefficient. Similarly, the magnitude of the applied current may also be used for adjusting the friction coefficients. Optionally, the current may correspond to an alternating current or a direct current, applied by application of an AC voltage or a DC voltage between punch 215 and die 220. Although current source 250 is shown as in electrical communication directly with punch 215 and die 220, the electrical communication of current source 250 with punch 215 and die 220 may be indirect, such as where one or more intervening circuits or conductive components are present between current source 250 and punch 215 or die 220.

The current applied may be suitable for achieving a desired friction coefficient or desired property of a lubricant. As examples, currents of from 0.01 mA to 12 A may be applied. In some cases, a current of 0 A (i.e., no current) may be used during certain forming operations. The friction coefficients that can be achieved may depend on the materials and compositions of the metal sheet 205, punch 215, die 220, first lubricant 235, and second lubricant 240, the magnitude and direction of the applied current and/or the voltage used to generate the current. As examples, friction coefficients ranging from 0.02 to 0.27 may be achieved. In some cases, the friction coefficient for a particular system may be referred to as a standard friction coefficient, which may be determined using a standard friction test according to an ASTM standard, such as an ASTM G115 standard, for example ASTM G115-10(2018), Standard Guide for Measuring and Reporting Friction Coefficients, ASTM International, West Conshohocken, PA, 2018, hereby incorporated by reference.

As noted above, the properties of the first lubricant 235 and/or the second lubricant 240 may be changed by the application of electric current to or through the lubricant(s). The effective property to be changed for the applications described herein may relate to modification of the friction coefficient between different surfaces lubricated by the lubricant, but other properties may relate to or be affected by or effect a change in the friction. For example, a viscosity of the first lubricant 235 and/or the second lubricant 240 may be changed by the application of electric current to or through the lubricant(s). In some cases, the viscosity of the first and/or second lubricant may optionally and independently vary from 2.5 mPas to 190 mPas. Optionally, application of an electric current to or through the lubricant(s) may increase or decrease the viscosity of the lubricant(s). Optionally, changing the viscosity may change friction. These property changes may occur in a controllable and reversible fashion, such that applying no current, followed by applying a current, followed by applying no current again may reversibly change the property to its original state. Without being bound by theory, the change in properties of the lubricant(s) may optionally arise through modifying the orientation and/or arrangement of the molecules or ions within the lubricant(s). In the case of lubricants comprising ionic liquids, for example, the ions of the ionic liquid (cations and anions) may be physically separated in space and/or oriented in particular directions by the application of electric current. In some cases, the orientation or arrangement of ions may be directed through application of a voltage.

Depending on the configuration and desired friction coefficients between metal sheet 205 and components of forming system 200, first lubricant 235 and second lubricant 240 may be the same or different. In some examples, punch 215 and die 220 comprise steel, while metal sheet 205 comprises an aluminum alloy. Optionally, first lubricant 235 or second lubricant 240 may comprise an ionic liquid, such as a salt that is molten at temperatures of less than about 100° C., such as from 0° C. to 100° C. Example ionic liquids may comprise an imidazolium cation, an ammonium cation, a pyrrolidinium cation, a phosphonium cation, a trihexyl(tetradecyl)phosphonium cation, a tetrafluoroborate anion, a hexafluorophosphate anion, a phosphate anion, a bis(trifluoromethylsulfonyl)amide anion, a bis(oxalate)borate anion, a perfluoroalkyulphosphate anion, a 1-n-3-methylimidazolium, a 1-n-2,3-methylimidazolium, or a 1-Allyl-3-methylimidazolium, such as $[C_4C_1IM][PF_6]$ and $[C_2C_1IM][BF_4]$. In some cases, first lubricant 235 or second lubricant 240 may comprise an aqueous lubricant, an oil-based lubricant, a wax-based lubricant, a petroleum-based lubricant, or a conductive lubricant. In some cases, a lubricant blend may be used, such as a lubricant comprising one or more of an ionic liquid, an aqueous lubricant, an oil-based lubricant, a wax-based lubricant, a petroleum-based lubricant, a conductive lubricant, synthetic esters, a polyol ester, a polyol-based lubricant, a polyalphaolefin, polyethylene glycol, glamour wax, fluidized paraffin, synthetic paraffin, paraffin oil, mineral oil, white vaseline, palm oil, natural wax, polyethylene wax, hydrogenated castor wax, bees wax, polyisobutylene, polyethylene glycol dioleate, a fatty acid, stearic acid, oleic acid, tall oils, recinoleic acid, palmitic acid, myristic acid, lauric acid, isostearic acid, a nonionic surfactant, an amine, morpholine, diethyl amino ethanolamine, or water.

First lubrication source 225 and second lubrication source 230 may be used to establish any suitable loading of lubricants on the surfaces of metal sheet 205. For example, lubricant loadings may optionally range from 0.1 $g/m^2$ to 1 $g/m^2$. First lubrication source 225 and second lubrication source 230 are depicted in FIG. 2 as positioned to apply first lubricant 235 and second lubricant 240 to metal sheet 205 prior to the metal sheet being inserted between die 220 and blankholder 245/punch 215. Other arrangements of first lubrication source 225 and second lubrication source 230 may alternatively be used. Optionally, first lubrication source 225 may apply first lubricant 235 to punch 215. Optionally, second lubrication source 230 may apply second lubricant 240 to die 220.

Figure 3:
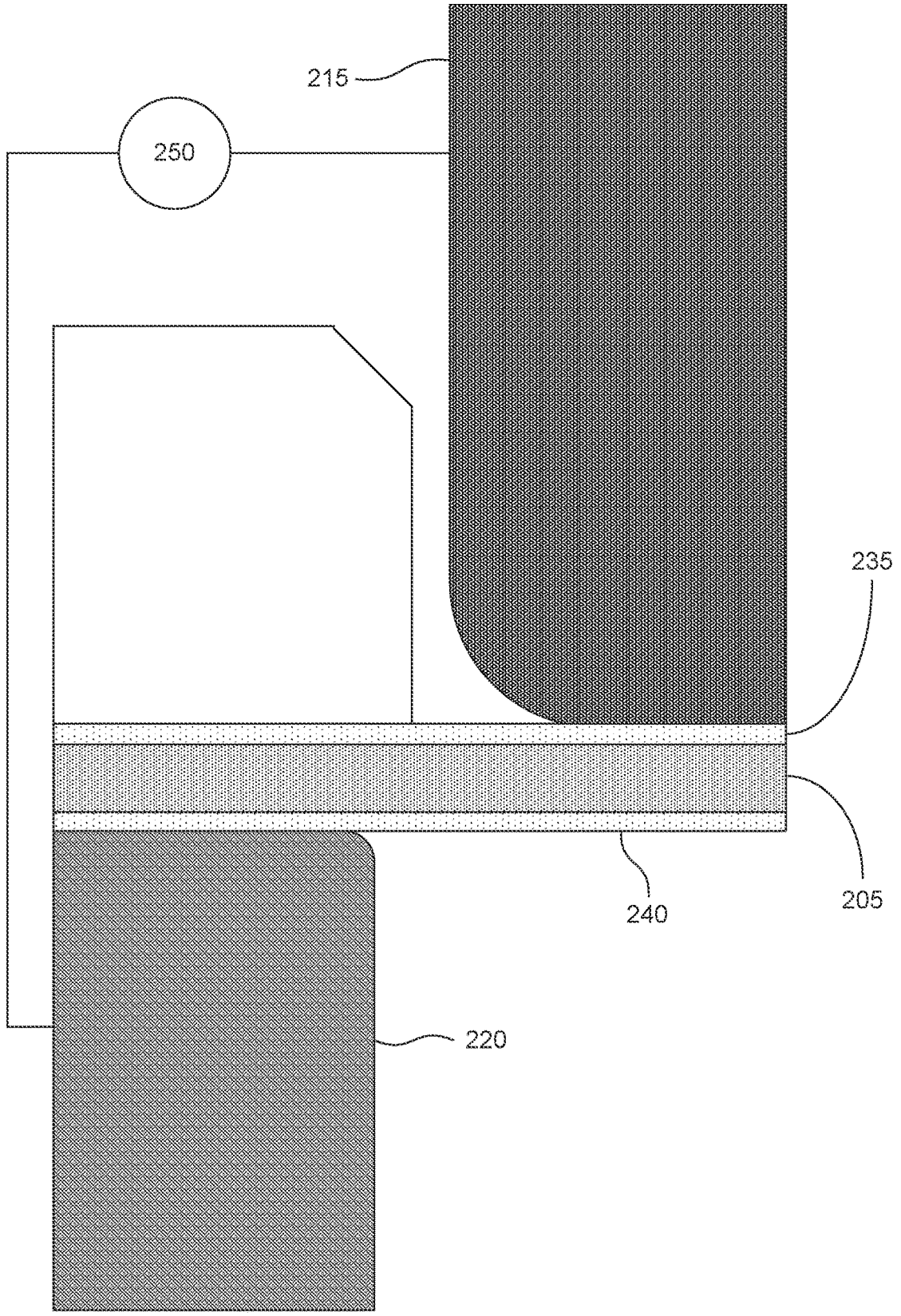
FIG. 3 provides a schematic illustration showing an expanded view of a metal sheet forming system at the start of a drawing process.

To control the friction between metal sheet 205 and punch 215, first lubricant 235 may be a controllable lubricant, such as comprising an ionic liquid, and a current may be applied to or through the first lubricant 235. Similarly, to control the friction between metal sheet 205 and die 220, second lubricant 240 may be a controllable lubricant, such as comprising an ionic liquid, and a current may be applied to or through the second lubricant 240. FIG. 3 depicts an expanded view of a section of forming system 200 at the beginning of or prior to the drawing process, and shows metal sheet 205, coated with first lubricant 235 and second lubricant 240 on opposite sides, punch 215, die 220 and current source 250. In the illustrated configuration, current may flow from punch 215, through first lubricant 235, metal sheet 205, and second lubricant 240 to die 220, or vice versa.

Figure 4:
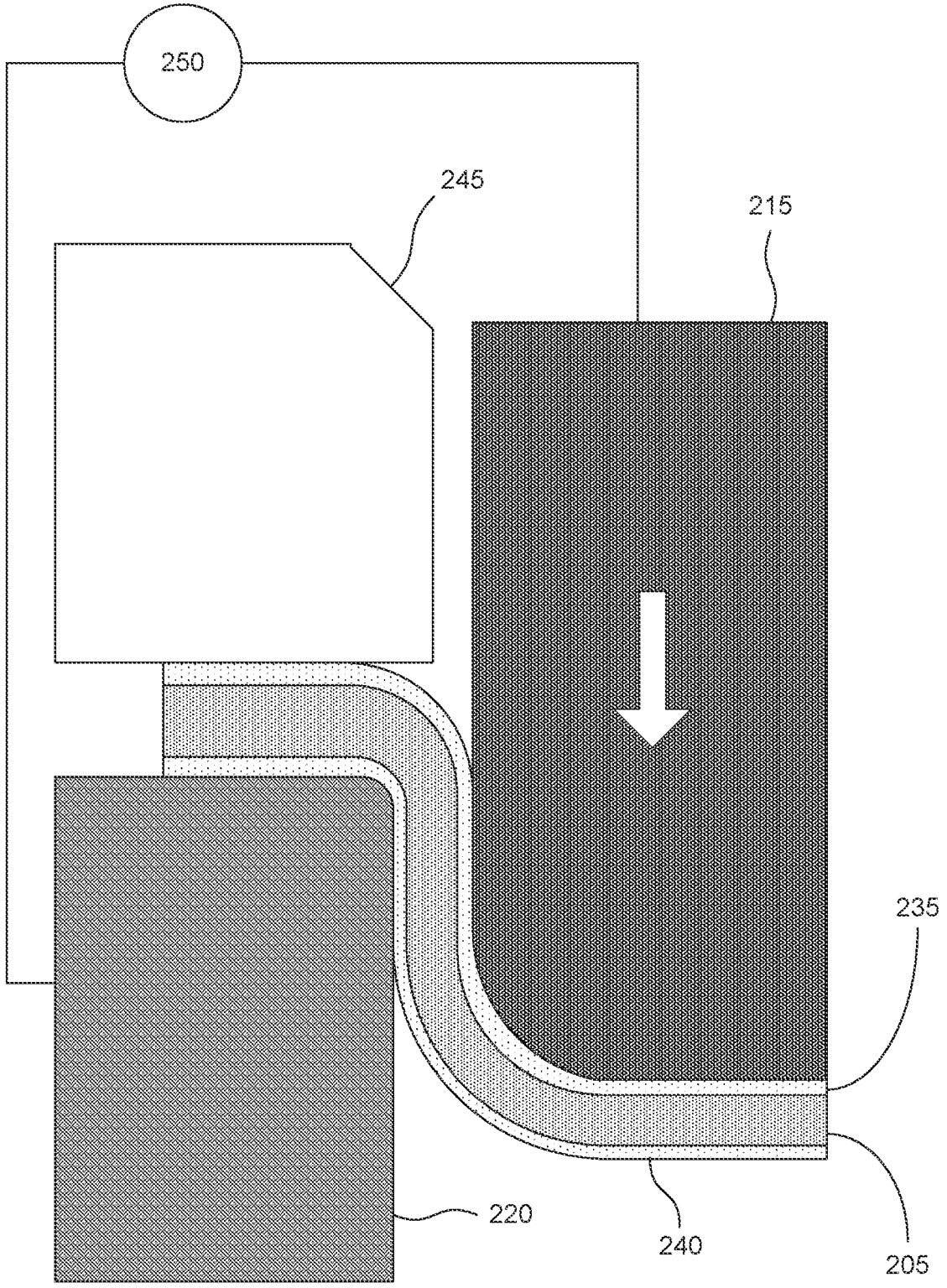
FIG. 4 provides a schematic illustration showing an expanded view of a metal sheet forming system during a drawing process.

FIG. 4 depicts an expanded view of the section of forming system 200 shown in FIG. 3 during the drawing process, with punch 215 depicted as moving in a downward direction relative to die 220. In some cases, it may be desirable for the friction coefficient between metal sheet 205 and punch 215 to be greater than the friction coefficient between metal sheet 205 and die 220 during drawing of metal sheet 205, so the compositions of first lubricant 235 and second lubricant 240 may be different, and the magnitude and direction of the applied current may be selected to achieved this. In one example, first lubricant 235 may comprise an ionic liquid having properties that can vary as a function of the applied voltage and/or current, while second lubricant 240 may comprise an oil-based lubricant having properties that do not vary as a function of the applied voltage and/or current. In other cases, it may be desirable for different friction coefficients to be used, so the applied voltage and/or current may be different and the compositions of first lubricant 235 and second lubricant 240 may be different.

Figure 5:
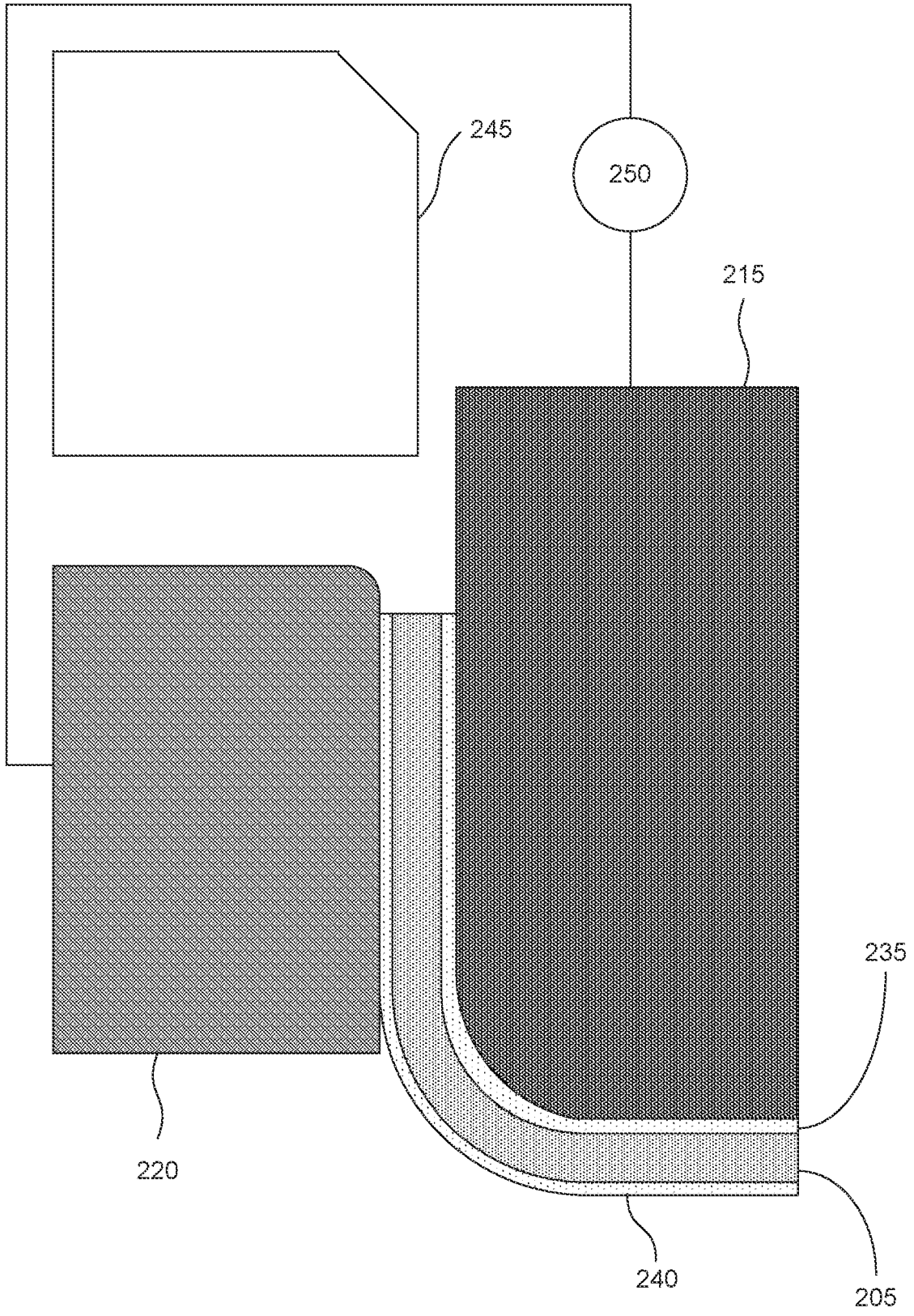
FIG. 5 provides a schematic illustration showing an expanded view of a metal sheet forming at the end of a drawing process.

As the drawing process completes, as shown in FIG. 5, motion of punch 215 in the downward direction relative to die 220 stops. At this point, the desired friction coefficients may change, so the application of current or voltage by current source 250 may change. For example, it may be desirable to reduce the friction coefficient between metal sheet 205 and punch 215 to as low a value as possible to allow for easy removal or separation of punch 215 from metal sheet 205, so the applied current and/or voltage may be altered from that used during the forming process as depicted in FIG. 4.

Figure 6:
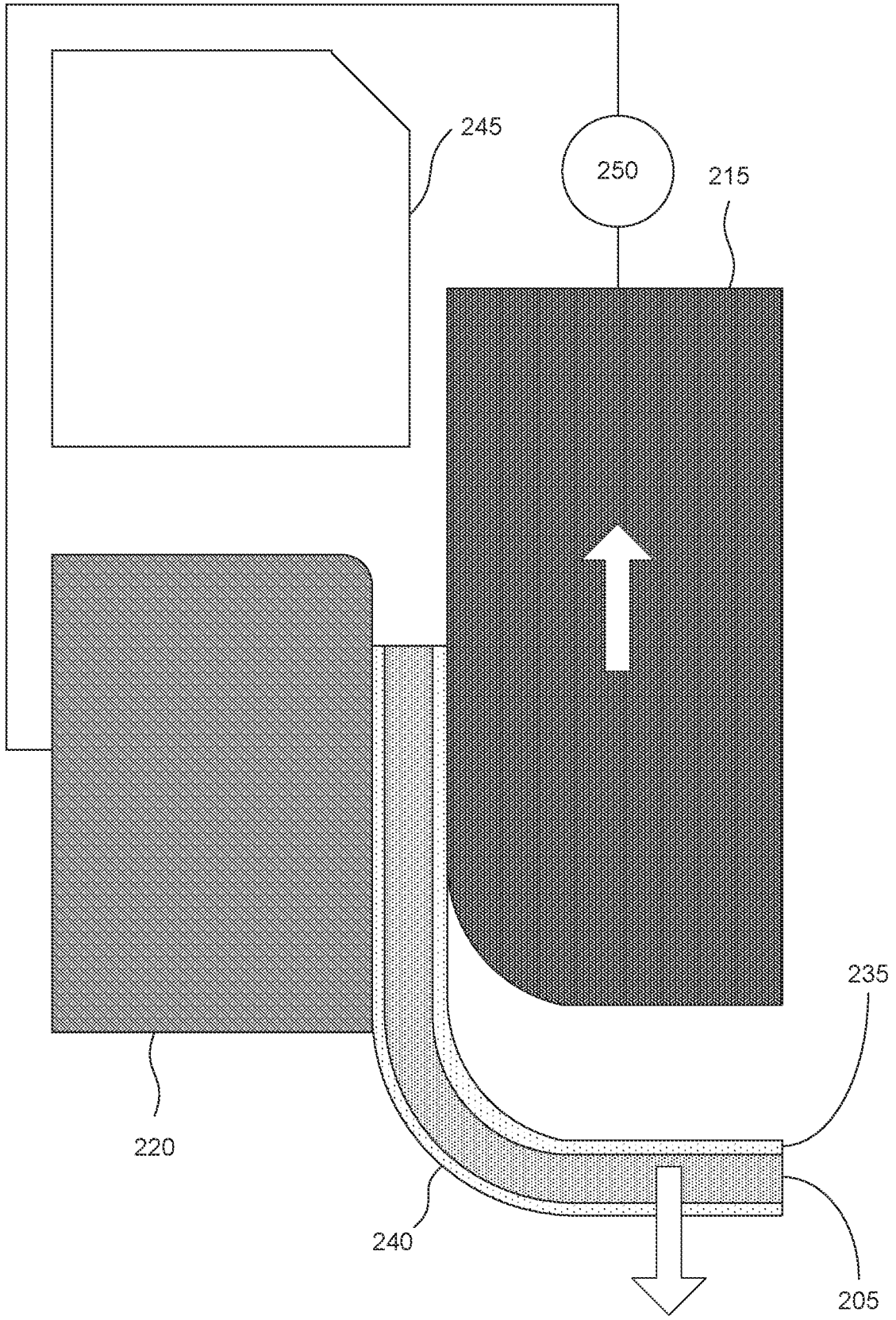
FIG. 6 provides a schematic illustration showing an expanded view of a metal sheet forming system during ejection of a metal product after completion of a drawing process.

FIG. 6 depicts the ejection of metal sheet 205, now drawn into a metal cup, from forming system 200, with metal sheet 205 moving in a downward direction relative to die 220 and punch 215 moving in an upward direction relative to die 220. For purposes of illustration, first lubricant 235 and second lubricant 240 are shown as being retained on metal sheet 205, but some amount of first lubricant 235 may be retained on punch 215 and some amount of second lubricant 240 may be retained on die 220.

Although the above description with respect to FIGS. 2-6 has been made with reference to a drawing process, application of the disclosed principles may similarly apply to a stamping or other forming process. For example, during stamping, it may be desirable to control the friction coefficients between a metal sheet and an upper stamping equipment and/or a lower stamping equipment. For example, in some cases it may be desired for the friction coefficient between the metal sheet and the upper stamping equipment to be greater than the friction coefficient between the metal sheet and the lower upper stamping equipment, or vice versa. In some applications, it may be desirable for the friction coefficients to be the same. However, it may also be desirable for the friction coefficients to change after completion of the stamping process. For example, it may be advantageous for the friction coefficients to reduce, allowing for easier separation or removal of the formed metal product from the upper and lower stamping equipment.

Figure 7:
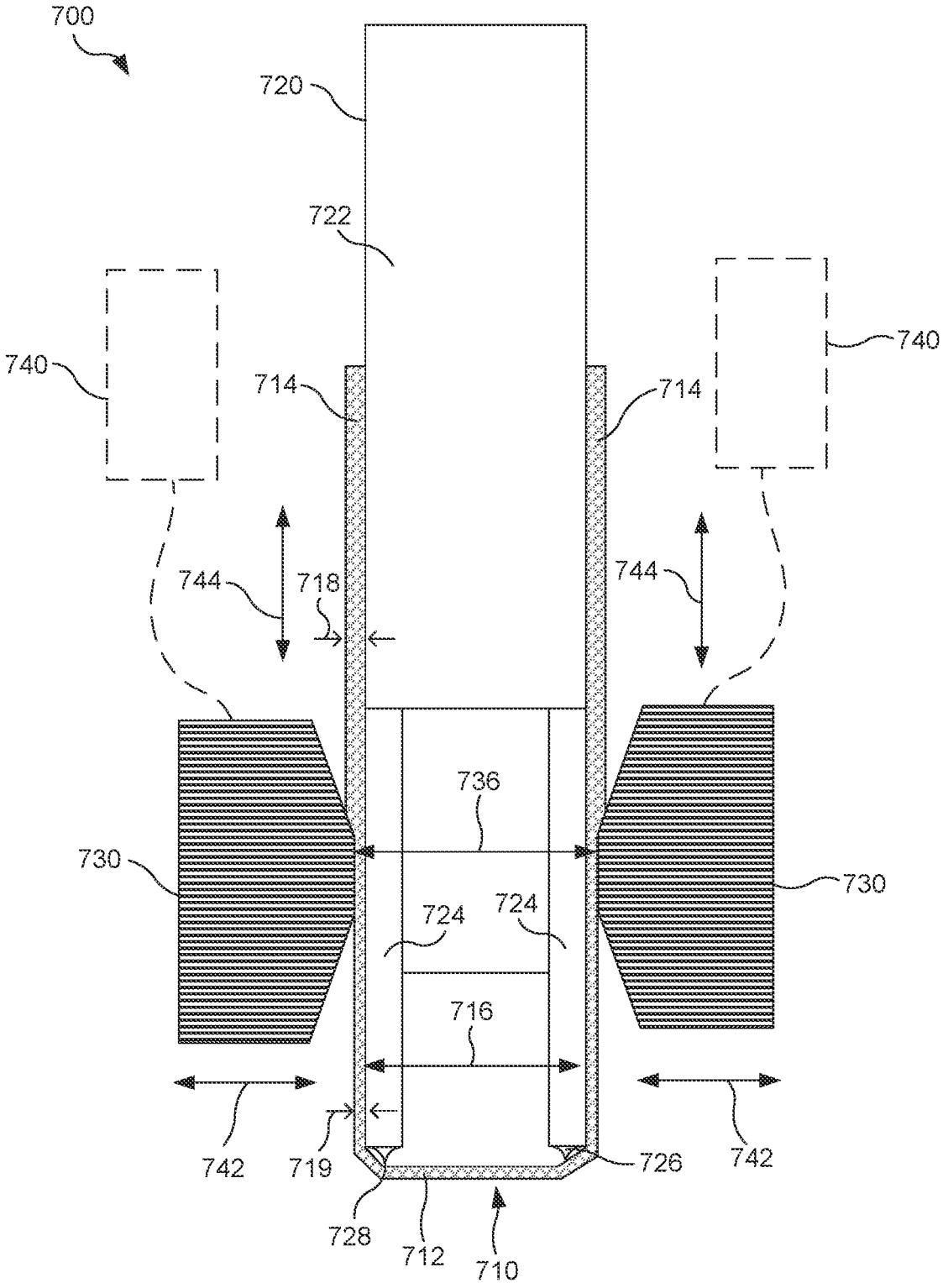
FIG. 7 is a cross-sectional side view of a portion of a container manufacturing system, according to aspects of the current disclosure.

For control over friction using ultrasonic vibration, examples are now described with respect to manufacturing of containers, such as beverage containers. It will be appreciated, however, that application of ultrasonic vibration to control friction may be used for other operations, such as stamping or other forming processes. FIG. 7 depicts a cross-sectional side view of a portion of a container manufacturing system 700. The container manufacturing system 700 may include a container preform 710, a ram 720, a die 730, and one or more ultrasonic devices 740.

The container preform 710 may be a piece of metal that has been formed into a shape (e.g., a can, a cup, a bottle preform, or the like). In various examples, the container preform 710 may be driven through a die, such as die 730, to form a shallow cup. The container preform 710 may include a base 712 and sidewalls 714. The container preform 710 may be aligned with and/or engaged with the ram 720 via the sidewalls 714 and/or the base 712. In some examples, the container preform 710 may be aligned with the ram 720 and the die 730 via a cup locator.

The container preform 710 may have an inner diameter 716, a starting wall thickness 718, and a reduced wall thickness 719. In various examples, the container preform 710 may have an inner diameter 716 of from 50 mm to 76 mm, a starting wall thickness 718 of from 0.14 mm to 0.16 mm, and/or a reduced wall thickness 719 of from 0.076 mm to 0.1 mm.

In various examples, the ram 720 may have a cylindrical shape for receiving and engaging with the container preform 710. The ram 720 may engage with and drive the container preform 710 through an opening 736 in the die 730. The ram 720 may engage with the base 712 of the container preform 710 and/or the sidewalls 714 of the container preform 710. For example, the end of the ram 720 may be engaged with the base 712 and the sides of the ram 720 may be engaged with the sidewalls 714. In some examples, the ram 720 may be driven through and withdrawn from the die 730 in a repeating pattern. For example, the ram 720 may engage with and drive a first container preform 710 through the die 730 in a first direction, disengage from the first container preform 710, retract through the die 730 in a second direction, and engage with and drive a second container preform 710 through the die 730 in the first direction, starting the cycle anew. In various examples, the ram 720 may be linearly driven through the die 730 using a flywheel, compressed fluid, air, a swing lever or other suitable mechanism. The ram 720 may be or include tool steel or carbide. In various examples, the ram 720 may correspond to or comprise components of a container preform body maker.

In some examples, the ram 720 may include a ram body 722, a punch sleeve 724, and/or a punch nose 726. A first end of the ram body 722 may be attached to a driving device for moving the ram 720 along a linear path and a second opposing end of the ram body 722 may be attached to the punch sleeve 724 and/or the punch nose 726. The punch sleeve 724 may engage with the sidewalls 714 of the container preform 710 and hold the container preform 710 against the die 730 to aid in the reduction of the sidewall thickness (e.g., from a starting wall thickness 718 to a reduced wall thickness 719). The punch sleeve 724 may have a constant diameter (e.g., similar to the inner diameter 716 of the container preform 710) or may have a variable diameter. In some examples, the punch nose 726 engages with the base 712 of the container preform 710 and aids in the reduction of the diameter of the container preform 710. Each side of the punch nose 726 may terminate at a contact point 728. The two contact points 728 may be set apart by a distance less than the inner diameter 716. However, the two contact points 728 may be set apart by a distance equal to the inner diameter 716.

One or more dies 730 may be used in combination with the ram 720 to reduce the wall thickness (e.g., from a starting wall thickness 718 to a reduced wall thickness 719) of the container preform 710. In some examples, the one or more dies 730 are part of a die assembly 800, discussed herein with respect to FIG. 8, and/or are part of a tool pack 1000, discussed herein with respect to FIG. 10.

In various examples, the die 730 may include an opening 736 sized and shaped for receiving the container preform 710 and/or the ram 720. For example, the opening 736 may be an elliptical or circular shaped opening. In various examples, the die 730 has an elliptical opening 736 with a diameter less than the combination of the inner diameter 716 of the container preform 710 and twice the starting wall thickness 718. In some examples, the elliptical opening 736 may have a diameter of from 45 to 80 mm (such as, but not limited to, from 50 mm to 76.5 mm). The opening 736 may compress the sidewalls 714 of the container preform 710 from the starting wall thickness 718 to the reduced wall thickness 719. Compressing the sidewalls 714 may increase the length of the sidewalls.

As an illustrative non-limiting example, the container preform 710 has an inner diameter 716 of from 60 mm to 70 mm and a starting wall thickness 718 of from 0.05 mm to 0.5 mm for a total thickness of from 60.1 mm to 71 mm (i.e., 60 mm+2×0.05 mm and 70 mm+2×0.5 mm). The inner diameter 716 contacts the ram 720 and remains constant while the starting wall thickness 718 is compressed to the reduced wall thickness 719. The opening 736 is a circular opening with a diameter of from 60 mm to 70 mm that receives the container preform 710 on the ram 720. The ram 720 drives the container preform 710 through the opening 736, reducing the overall diameter of the container preform to equal the diameter of the opening (e.g., from 60 mm to 70 mm). The reduced overall diameter of the container preform 710 results in the container preform having a reduced wall thickness 719.

In some examples, multiple dies 730 may be used to progressively decrease the thickness of the sidewalls 714 of the container preform 710 (e.g., the reduced wall thickness 719 of a first die may be the starting wall thickness 718 of a second die). For example, three dies 730 may be positioned in series. In such a scenario, each respective die may have an opening that is progressively smaller than the opening of the immediately preceding die. As the container preform 710 is driven through each successive die 730, the sidewalls 714 are progressively compressed. This compression may cause the sidewalls 714 to be made progressively thinner. This may additionally or alternatively cause the sidewalls 714 to become progressively longer. In some examples, only a portion of the container preform 710 may contact multiple dies, for example, due to the positioning of the dies 730 and/or the ram 720 having a diameter that progressively narrows from the distal end to the proximal end. In further examples, as the ram 720 drives the container preform 710 through the opening 736 of the die 730, the diameter of the ram 720 engaged with the base 712 of the container preform 710 may cause the base 712 to contact all of the dies 730 and the narrower diameter of the ram 720 engaged with the sidewalls 714 of the container preform 710 may contact some and/or none of the dies 730.

One or more ultrasonic devices 740 may be coupled with the one or more dies 730 to vibrate the dies 730. One ultrasonic device 740 may be coupled with a single die 730 or may be coupled with multiple dies 730. The ultrasonic device 740 may be coupled with the dies 730 and positioned to vibrate the dies 730 in a radial direction (e.g., in direction 742) and/or in an axial direction (e.g., in direction 744). The ultrasonic device 740 may be a device that produces mechanical waves or oscillations at a frequency. For example, the ultrasonic device 740 may generate a frequency in a range of from 10 kHz to 1000 kHz, such as from 10 kHz to 25 kHz, from 25 kHz to 50 kHz, from 50 kHz to 100 kHz, from 100 kHz to 150 kHz, from 150 kHz to 200 kHz, from 200 kHz to 250 kHz, from 250 kHz to 300 kHz, from 300 kHz to 350 kHz, from 350 kHz to 400 kHz, from 400 kHz to 450 kHz, from 450 kHz to 500 kHz, from 500 kHz to 550 kHz, from 550 kHz to 600 kHz, from 600 kHz to 650 kHz, from 650 kHz to 700 kHz, from 700 kHz to 750 kHz, from 750 kHz to 800 kHz, from 800 kHz to 850 kHz, from 850 kHz to 900 kHz, from 900 kHz to 950 kHz, from 950 kHz to 1000 kHz, or anywhere in between (e.g., 10 kHz, 50 kHz, 100 kHz, 200 kHz, 300 kHz, 400 kHz, 500 kHz, 600 kHz, 700 kHz, 800 kHz, 900 kHz, 1000 kHz, etc). The ultrasonic device 740 may include an electronic oscillator and a transducer. The electronic oscillator may produce an alternating current oscillating at a frequency. The transducer may be attached to the die 730 and convert the oscillating current to a mechanical vibration to vibrate the die 730. The transducer may correspond to or comprise a piezoelectric transducer or a magnetostrictive transducer or other suitable transducer. In some examples, the ultrasonic device 740 may include a sonotrode positioned between the transducer and the die 730 to cause the die 730 to vibrate.

In some examples, the ultrasonic device 740 causes the die 730 to vibrate and reduce the friction between the container preform 710 and the die 730. Reducing the amount of friction between the die 730 and the container preform 710 may allow for a greater reduction in wall thickness of the container preform 710 and/or use of a container preform 710 with a thinner starting wall thickness 718. Additionally or alternatively, reducing the amount of friction between the die 730 and the container preform 710 may reduce the number of die assemblies 730 needed in the container manufacturing system 700. Reducing the amount of friction may allow different metal to be used in the container preform 710 and/or allow for less and/or alternative lubrication to be used in the manufacturing process.

In various examples, the ultrasonic device 740 may vibrate the die 730 to reduce buildup of metal on the die 730. The buildup of metal may be the result of the container preform 710 contacting the die 730. For example, each time a container preform 710 is driven through the die 730, a small amount of metal may be deposited on the die 730. Reduction of metal on the die 730 may reduce the amount of friction between the die 730 and the container preform 710. The reduction of metal on the die 730 may additionally or alternatively increase the functional life of the die 730.

In further examples, the ultrasonic device 740 may vibrate the die 730 to reduce internal stresses in the container preform 710. The reduction of internal stresses in the container preform 710 may result in fewer tear off and/or less work hardening of the container preform.

Figure 8:
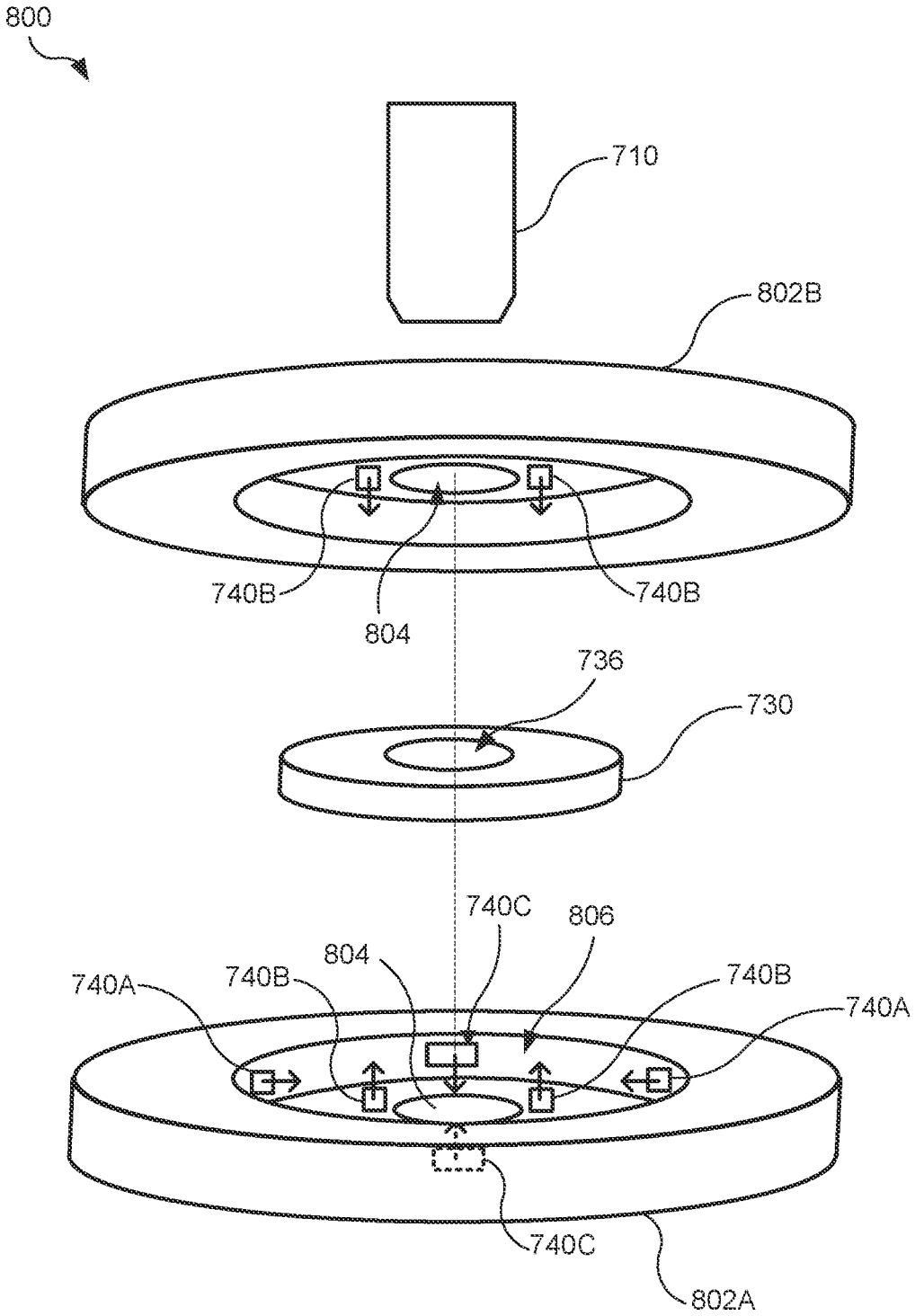
FIG. 8 is an illustration of an exploded view of an example die assembly for use with the container manufacturing system of FIG. 7, according to aspects of the current disclosure.

FIG. 8 is an illustration of an exploded view of an example die assembly 800 for use with the container manufacturing system 700 of FIG. 7, according to aspects of the current disclosure. The die assembly 800 may include one or more spacers. As shown, die assembly 800 includes two spacers 802A and 802B (also collectively or individually referred to herein as spacers 802), a die 730, and multiple ultrasonic devices 740, however, the die assembly 800 may include an additional and/or an alternative number of components.

The die 730, as pictured, is a circular plate with a circular opening 736 for receiving a container preform 710 engaged with a ram. As discussed in reference to FIG. 7, the opening 736 has a diameter smaller than the received container preform 710 to reduce the wall thickness of the container preform. The die 730 may include metal and/or other material strong enough to retain its shape while resisting the force of the punch driving the container preform 710 through the opening 736. In various examples, multiple dies 730 may be used, each with a differently sized diameter. In some examples, the die 730 may correspond to or comprise a redraw die, an ironing die, or a pilot die.

The die 730 may be coupled with, and held in place by, one or more spacers 802 during the forming process. The spacers 802 may be positioned on opposing sides of one or more dies 730. The spacers 802 may additionally or alternatively be positioned between dies 730 allowing the container preform 710 to be in contact with only one die 730 at a time. The spacers 802 may provide an area for lubrication to be added to the container preform 710 and/or the die 730 during the forming process.

As illustrated in FIG. 8, two spacers 802A and 802B are used to hold the die 730, one placed on either side of the die. The spacers 802 may include a recessed area 806 sized and shaped surrounding the outer diameter of the die 730. For example, the recessed area may be sized and shaped to receive the die 730 and hold the die in place. The spacers 802 may include an aperture 804. The aperture 804 may have the same or similar shape as the opening 736 in the die 730. The aperture 804 may be larger than the opening 736 of the die 730. The spacers 802 may include mounting points for ultrasonic devices 740A, 740B, and 740C. The ultrasonic devices 740A, 740B, and 740C may be mounted for vibrating the die 730 along one or more directions. For example, ultrasonic devices 740B may be mounted for vibrating of the die 730 along direction 742. Additionally or alternatively, ultrasonic devices 740A and/or 740C may be positioned for vibrating the die 730 along direction 744. In some examples, the spacers 802 may include additional or alternative mounting points for the ultrasonic devices 740A, 740B, and 740C and/or channels for lubrication or cable routing.

In examples where multiple spacers 802 are used, less than all spacers may be coupled with ultrasonic devices. For example, if two spacers 802 are used, a first spacer may be devoid of ultrasonic devices while a second spacer may be coupled with an ultrasonic device, for example, 740A, 740B, and/or 740C.

The ultrasonic devices 740A, 740B, and 740C may be coupled with the spacers and vibrate the die 730 at an ultrasonic frequency. The die 730 vibrating at an ultrasonic frequency may reduce friction between the die 730 and the container preform 710 when the container preform 710 is being driven through the die 730. Additionally or alternatively, the die 730 vibrating at an ultrasonic frequency may reduce metal buildup that may occur on the die 730.

Shown in FIG. 8 are various mounting options for the ultrasonic devices 740A, 740B, and 740C, however, the ultrasonic devices may be mounted in any suitable configuration. In the example of FIG. 8, two pairs of opposing ultrasonic devices 740A, 740C are on spacer 802A to point radially inward toward the aperture 804 and two pairs of ultrasonic devices 740B are mounted on opposing spacers 802A, 802B.

Mounting ultrasonic devices 740A, 740B, and 740C in pairs may allow resulting vibrations to be balanced. For example, balancing the vibrations may at least partially counteract or prevent substantial amounts of vibrations from traveling outside of the die 730, such as into the spacers 802 or beyond.

Figure 9:
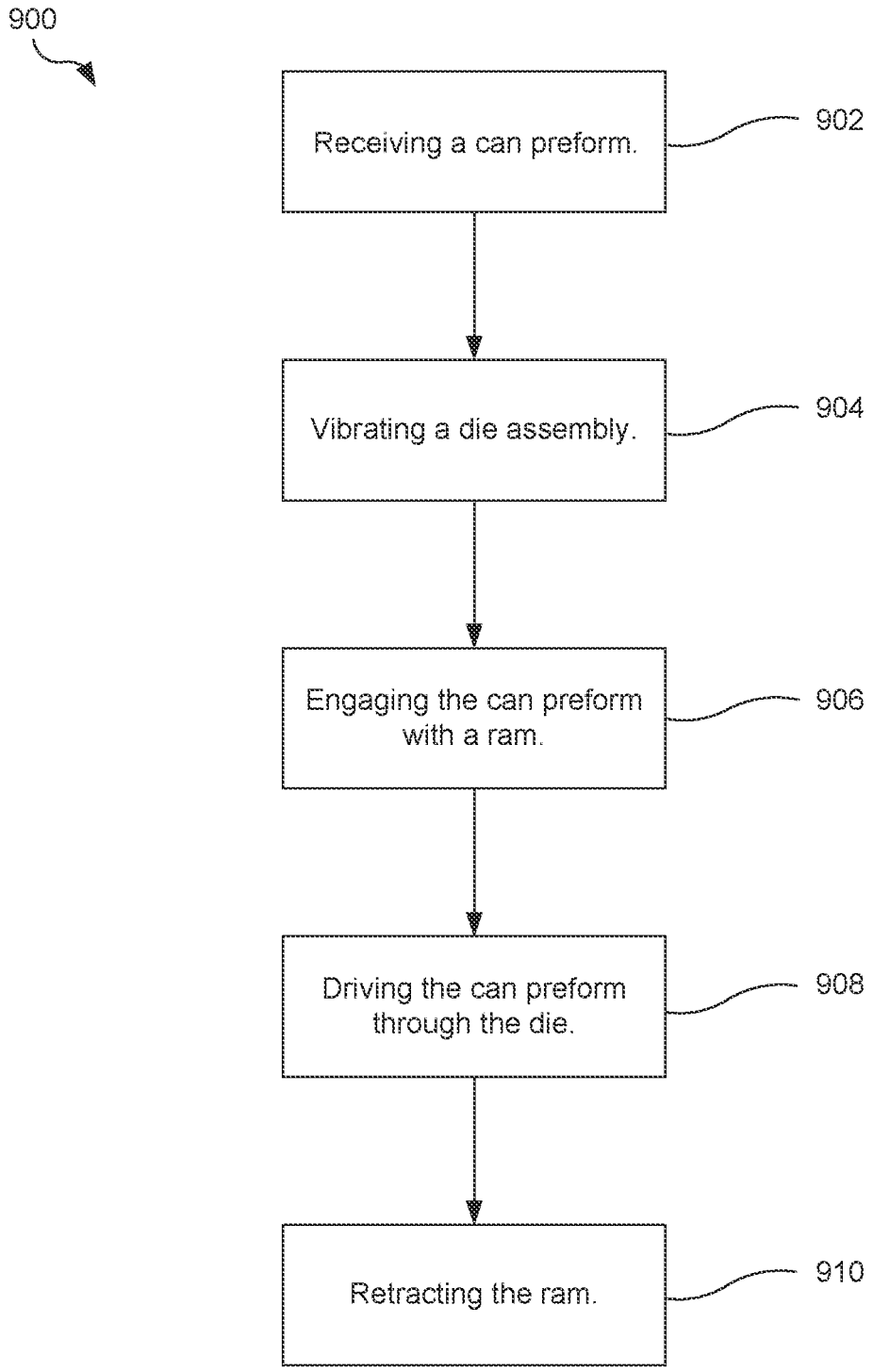
FIG. 9 is a flowchart illustrating an example process of forming an aluminum container using the container manufacturing system of FIG. 7, according to aspects of the current disclosure.

FIG. 9 is a flowchart illustrating an example of a process 900 for using a container manufacturing system to form an aluminum container, according to aspects of the current disclosure. The process 900 at 902 may include receiving a container preform, such as container preform 710, into a container manufacturing system, such as container manufacturing system 700. The container preform 710 may have a base and walls for engaging with a ram, such as ram 720, as explained herein. In some examples, the container preform 710 is received from a cutting machine. In various examples, the container preform 710 is positioned in the container manufacturing system 700 using a cup locator.

The process 900 at 904 includes vibrating a die assembly, such as the die assembly 800 described herein. The die assembly 800 may be vibrated using an ultrasonic device, such as ultrasonic device 740. The ultrasonic device 740 may vibrate some or all of the die assembly 800. For example, the ultrasonic device 740 may vibrate the die 730 and/or the one or more spacers 802. The ultrasonic device 740 may be connected to the die assembly 800 to vibrate the die assembly along one or more directions. For example, the ultrasonic device 740 may be placed at one or more various points in the die assembly 800 to vibrate the die assembly 800 in a radial direction. Additionally or alternatively, the ultrasonic device 740 may vibrate the die assembly 800 in an axial direction. In some examples, the ultrasonic device 740 may vibrate the die assembly 800 in multiple directions. Multiple directions of vibrations may be imparted simultaneously or sequentially. As an illustrative example of sequentially imparting multiple directions of vibrations, the ultrasonic device 740 may vibrate the die assembly 800 axially when the container preform 710 is driven through the die 730 and radially when the ram 720 is retracting through the die assembly.

In various examples, vibrating the die assembly 800 may be implemented during or in between other listed actions (e.g., 902-910). For example, the die assembly 800 may be vibrated before, during, and/or after the process 900 at 910, where the container preform 710 is driven through the opening 736 by the ram 720. Vibrating the die assembly 800 may occur during any and/or all of the actions 902-910. Vibrating the die assembly 800 between and/or before actions may allow the die assembly 800 to shake off a build-up of metal shavings and/or lubrication. In some examples, the die assembly 800 may be vibrated at multiple frequencies depending on the action taking place and/or whether an action is taking place at all.

The process 900 at 906 includes engaging the container preform 710 with the ram 720. The ram 720 engages the container preform 710 by moving along a linear path until an end of the ram 720 is engaged with the base and/or walls of the container preform 710. In some examples, the ram 720 may be moved along the linear path via a flywheel and engage the container preform 710. In some examples, the ram 720 engages the container preform 710 via a punch nose, such as the punch nose 726.

The process 900 at 908 includes driving the container preform 710 through the vibrating die assembly 800. For example, the container preform 710 may be driven through the opening 736 in the die 730 via the ram 720. In some examples, the opening 736 may have a size and shape that is smaller than the size and shape of the container preform 710. For example, the opening 736 may have a diameter that is smaller than the inner diameter 716 of the container preform 710. The opening 736 having a smaller size and shape may cause the sidewalls 714 of the container preform 710 to compress, reducing the thickness of the sidewalls when the container preform 710 is driven through opening 736 of the die 730. In various examples, vibrating the die assembly 800 at 904 may reduce the friction between the container preform 710 and the die 730 when the container preform 710 is being driven through the opening 736. For example, vibrating the die assembly 800 reduces the amount of friction that would otherwise occur between the container preform 710 and the die 730 when the thickness of the sidewalls 714 of the container preform 710 is reduced.

The process 900 at 910 includes retracting the ram 720 through the die assembly 800. In some examples, vibrating the die assembly 800 (i.e., process 900 at 904) may occur simultaneously with the ram 720 being retracted through the die assembly 800 (i.e., process 900 at 910). The ultrasonic device 740 may vibrate the die assembly 800 in the same direction and/or at the same frequency as when the container preform 710 is being driven through the die assembly 800. However, the ultrasonic device 740 may vibrate the die assembly 800 in a different direction and/or at a different frequency than when the container preform 710 is being driven through the die assembly 800. Additionally or alternatively, the die assembly 800 may not be vibrated at all as the ram 720 is retracted, or the die assembly 800 may be vibrated while the ram 720 is retracted at 910 and not while the container preform is being driven at 908. After retraction through the die assembly 800, the container manufacturing system 700 may receive an additional container preform 710 to be driven through the die assembly 800.

Figure 10:
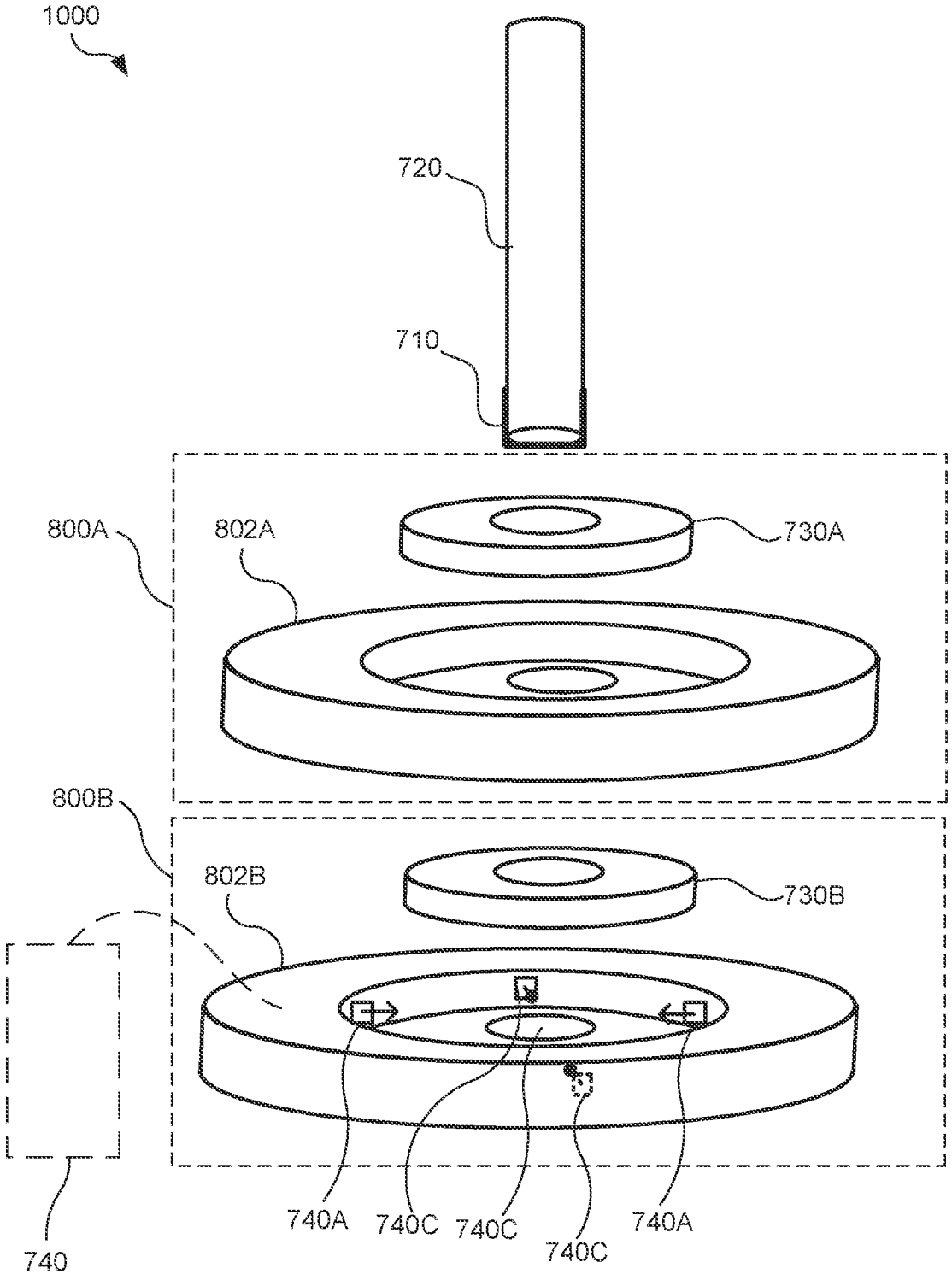
FIG. 10 is an illustration of an example tool pack for use with the container manufacturing system of FIG. 7, according to aspects of the current disclosure.

FIG. 10 is an example tool pack 1000 of the container manufacturing system of FIG. 7, according to aspects of the current disclosure. The tool pack 1000 includes a non-vibrating die assembly 800A and a vibrating die assembly 800B. The vibrating die assembly 800B is connected to and vibrated by the ultrasonic device 740.

The non-vibrating die assembly 800A may include one or more spacers 802A and one or more non-vibrating dies 730A. The spacers 802A may be positioned such that the non-vibrating die 730A and the vibrating die 730B are separated by at least one spacer 802A. For example, the non-vibrating die 730A may be separated from the vibrating die 730B by spacer 802A. The non-vibrating die assembly 800A may receive a container preform 710 driven by a ram 720. The non-vibrating die 730A may be or include a non-vibrating die (e.g., a redraw die or a first ironing die).

The vibrating die assembly 800B may include one or more spacers 802B and one or more dies 730B. The vibrating die assembly 800B may be connected with an ultrasonic device 740 that vibrates one or more components of the die assembly 800B. For example, the ultrasonic device 740 may be connected with the dies 730B to vibrate the dies. The ultrasonic device 740 may be positioned to vibrate the dies 730B radially. Additionally or alternatively, the ultrasonic device 740 may be positioned to vibrate the dies 730B axially. The ultrasonic device 740 may vibrate the dies 730B before, during, and/or after the container preform 710 is driven through the non-vibrating die assembly 800A. One ultrasonic device 740 may be individually connected each of the dies 730B and/or spacer 802B. However, one ultrasonic device 740 may be connected to multiple dies 730B and/or spacers 802B. The ultrasonic device 740 may also correspond to multiple ultrasonic devices 740.

The tool pack 1000 may include different combinations and/or patterns of non-vibrating die assemblies 800A and vibrating die assemblies 800B. In some examples, the tool pack 1000 includes multiple sets of non-vibrating die assemblies 800A and one vibrating die assembly 800B. For example, two non-vibrating die assemblies 800A may be positioned before one vibrating die assembly 800B, such that, the container preform 710 is driven through the non-vibrating die assemblies 800A before being driven through the vibrating die assembly 800B. However, non-vibrating die assembly 800A may be positioned after the vibrating die assembly 800B and/or on either side of the vibrating die assembly 800B.

The tool pack 1000 may include multiple sets of vibrating die assemblies 800B. The multiple sets of vibrating die assemblies 800B may be positioned before a non-vibrating die assembly 800A, after a non-vibrating die assembly 800A, and/or on either side of a non-vibrating die assembly 800A. In some examples, the tool pack 1000 may include only one vibrating die assembly 800B without any accompanying non-vibrating die assembly 800A.

Methods of Using the Disclosed Aluminum Alloy Products

The metal products and associated methods described herein can be used in automotive applications and other transportation applications, including aircraft and railway applications, or any other desired application. For example, the disclosed metal products can be used to prepare automotive structural parts, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The metal products and methods described herein can also be used in aircraft or railway vehicle applications, to prepare, for example, external and internal panels.

The metal products and associated methods described herein can also be used in electronics applications. For example, the metal products and methods described herein can be used to prepare housings for electronic devices, including mobile phones and tablet computers. In some examples, the metal products can be used to prepare housings for the outer casing of mobile phones (e.g., smart phones), tablet bottom chassis, and other portable electronics.

The metal products and associated methods described herein can be used in food or beverage container applications. For example, the metal products and methods described herein can be used to prepare beverage containers, such as aluminum cans and bottles.

The examples disclosed herein will serve to further illustrate aspects of the invention without, at the same time, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. The examples and embodiments described herein may also make use of conventional procedures, unless otherwise stated. Some of the procedures are described herein for illustrative purposes.

Illustrative Aspects

As used below, any reference to a series of aspects (e.g., "Aspects 1-4") or non-enumerated group of aspects (e.g., "any previous or subsequent aspect") is to be understood as a reference to each of those aspects disjunctively (e.g., "Aspects 1-4" is to be understood as "Aspects 1, 2, 3, or 4").

Aspect 1 is a method of making a metal product, comprising: applying a first lubricant on a punch side of a sheet metal blank; applying a second lubricant on a die side of the sheet metal blank; drawing the sheet metal blank using a punch and a die to form the sheet metal blank into a metal product while controlling one or both of a first coefficient of friction between the punch side of the sheet metal blank or a second coefficient of friction between the die side of the sheet metal blank and the die such that the first coefficient of friction is greater than the second coefficient of friction; and ejecting the metal product from the die while controlling a third coefficient of friction between the metal product and the punch to be less than the first coefficient of friction.

Aspect 2 is the method of any previous or subsequent aspect, wherein controlling the first coefficient of friction comprises applying a first electric current through the first lubricant or applying the first electric current through the second lubricant, and wherein controlling the third coefficient of friction comprises applying a second electric current through the first lubricant.

Aspect 3 is the method of any previous or subsequent aspect, wherein the first electric current has a magnitude of from 0.01 mA to 12 A.

Aspect 4 is the method of any previous or subsequent aspect, wherein the second electric current has a magnitude of from 0.01 mA to 12 A.

Aspect 5 is the method of any previous or subsequent aspect, wherein the first electric current or the second electric current, but not both, has a magnitude of 0 A.

Aspect 6 is the method of any previous or subsequent aspect, wherein the first electric current is applied using a voltage of from 0.05 V to 6 V or wherein the second electric current is applied using a voltage of from 0.05 V to 6 V.

Aspect 7 is the method of any previous or subsequent aspect, wherein the first electric current is applied between the punch and the die or between the punch and the sheet metal blank or wherein the second electric current is applied between the punch and the die or between the punch and the metal product.

Aspect 8 is the method of any previous or subsequent aspect, wherein the first electric current flows from the punch to the die through at least the first lubricant, from the die to the punch through at least the first lubricant, from the punch to the sheet metal blank through at least the first lubricant, from the sheet metal blank to the punch through at least the first lubricant, from the punch to the die through at least the second lubricant, from the die to the punch through at least the second lubricant, from the die to the sheet metal blank through at least the second lubricant, or from the sheet metal blank to the die through at least the second lubricant.

Aspect 9 is the method of any previous or subsequent aspect, wherein the second electric current flows from the punch to the die through at least the first lubricant, from the die to the punch through at least the first lubricant, from the punch to the metal product through at least the first lubricant, or from the metal product to the punch through at least the first lubricant.

Aspect 10 is the method of any previous or subsequent aspect, wherein the first lubricant and the second lubricant are different lubricants.

Aspect 11 is the method of any previous or subsequent aspect, wherein the first lubricant and the second lubricant are a same lubricant.

Aspect 12 is the method of any previous or subsequent aspect, wherein the first lubricant comprises an ionic liquid.

Aspect 13 is the method of any previous or subsequent aspect, wherein the first lubricant further comprises one or more of an aqueous lubricant, an oil-based lubricant, a wax-based lubricant, an oil-based lubricant, a petroleum-based lubricant, synthetic esters, a polyol ester, a polyol-based lubricant, a polyalphaolefin, polyethylene glycol, glamour wax, fluidized paraffin, synthetic paraffin, paraffin oil, mineral oil, white vaseline, palm oil, natural wax, polyethylene wax, hydrogenated castor wax, bees wax, polyisobutylene, polyethylene glycol dioleate, a fatty acid, stearic acid, oleic acid, tall oils, recinoleic acid, palmitic acid, myristic acid, lauric acid, isostearic acid, a nonionic surfactant, an amine, morpholine, diethyl amino ethanolamine, or water.

Aspect 14 is the method of any previous or subsequent aspect, wherein the ionic liquid comprises an imidazolium cation, an ammonium cation, a pyrrolidinium cation, a phosphonium cation, a trihexyl(tetradecyl)phosphonium cation, a tetrafluoroborate anion, a hexafluorophosphate anion, a phosphate anion, a bis(trifluoromethylsulfonyl) amide anion, a bis(oxalate)borate anion, a perfluoroalkylphosphate anion, a 1-n-3-methylimidazolium, a 1-n-2,3-methylimidazolium, a 1-Allyl-3-methylimidazolium, $[C_4C_1IM][PF_6]$, or $[C_2C_1IM][BF_4]$.

Aspect 15 is the method of any previous or subsequent aspect, wherein the second lubricant comprises one or more of an ionic liquid, an aqueous lubricant, an oil-based lubricant, a wax-based lubricant, an oil-based lubricant, a petroleum-based lubricant, or a conductive lubricant.

Aspect 16 is the method of any previous or subsequent aspect, wherein applying the first lubricant comprises establishing a loading of the first lubricant on the punch side of the sheet metal blank of from 0.1 $g/m^2$ to 1 $g/m^2$.

Aspect 17 is the method of any previous or subsequent aspect, wherein applying the second lubricant comprises establishing a loading of the second lubricant on the die side of the sheet metal blank of from 0.1 $g/m^2$ to 1 $g/m^2$.

Aspect 18 is the method of any previous or subsequent aspect, wherein the first coefficient of friction corresponds to a standard coefficient of friction using the first lubricant between the sheet metal blank and the punch of from 0.02 to 0.27.

Aspect 19 is the method of any previous or subsequent aspect, wherein the third coefficient of friction corresponds to a standard coefficient of friction using the first lubricant between the metal product and the punch of from 0.02 to 0.27.

Aspect 20 is the method of any previous or subsequent aspect, wherein the first lubricant exhibits a viscosity of from 2.5 mPas to 190 mPas during the drawing.

Aspect 21 is the method of any previous or subsequent aspect, wherein the first lubricant exhibits a viscosity of from 2.5 mPas to 190 mPas during the ejecting.

Aspect 22 is the method of any previous or subsequent aspect, wherein the sheet metal blank comprises an aluminum alloy.

Aspect 23 is the method of any previous or subsequent aspect, wherein the sheet metal blank comprises a 3xxx series aluminum alloy, an AA3003 alloy, an AA3004 alloy, an AA3104 alloy, or an AA3105 alloy.

Aspect 24 is the method of any previous or subsequent aspect, wherein one or both of the punch or the die comprises steel.

Aspect 25 is the method of any previous or subsequent aspect, wherein the metal product comprises a metal cup, a redrawn metal cup, a metal bottle preform.

Aspect 26 is a system for making a metal product, comprising: a lubrication source for applying a first lubricant on a punch side of a sheet metal blank; a controllable current source for applying different amounts of current; and a punch and a die for drawing the sheet metal blank into a metal product, wherein the controllable current source is electrically coupled to one or more of the punch, the die, or a contact point for applying current through the first lubricant while the sheet metal blank is drawn by the punch and the die into the metal product and while the metal product is being ejected from the punch.

Aspect 27 is the system of any previous or subsequent aspect, wherein the controllable current source is configured to apply a first current through the first lubricant during drawing of the sheet metal blank and to apply a second current through the first lubricant during ejection of the metal product.

Aspect 28 is the system of any previous or subsequent aspect, wherein the first lubricant comprises an ionic liquid.

Aspect 29 is the system of any previous aspect, wherein the first lubricant further comprises one or more of an aqueous lubricant, an oil-based lubricant, a wax-based lubricant, an oil-based lubricant, a petroleum-based lubricant, synthetic esters, a polyol ester, a polyol-based lubricant, a polyalphaolefin, polyethylene glycol, glamour wax, fluidized paraffin, synthetic paraffin, paraffin oil, mineral oil, white vaseline, palm oil, natural wax, polyethylene wax, hydrogenated castor wax, bees wax, polyisobutylene, polyethylene glycol dioleate, a fatty acid, stearic acid, oleic acid, tall oils, recinoleic acid, palmitic acid, myristic acid, lauric acid, isostearic acid, a nonionic surfactant, an amine, morpholine, diethyl amino ethanolamine, or water.

Aspect 30 is a container manufacturing system, comprising: a cylindrical ram comprising a ram body and a ram nose on a distal end of the ram body, the ram nose engagable with a base of a container preform; a die comprising an opening concentrically aligned with the cylindrical ram, the opening sized and shaped for receiving the container preform in response to the ram nose engaging with the base of the container preform and the cylindrical ram driving the container preform through the die opening; and an ultrasonic device coupled with the die, wherein the ultrasonic device causes the die to vibrate while the cylindrical ram drives the container preform through the die opening.

Aspect 31 is the container manufacturing system of any previous or subsequent aspect, wherein the die is a first die and the container manufacturing system further comprises a second die having an opening for receiving the container preform and concentrically aligned with the opening of the first die and the cylindrical ram.

Aspect 32 is the container manufacturing system of any previous or subsequent aspect, wherein the ultrasonic device is a first ultrasonic device and the container manufacturing system further comprises a second ultrasonic device coupled with the second die causing the second die to vibrate while the cylindrical ram drives the container preform through the second die opening.

Aspect 33 is the container manufacturing system of any previous or subsequent aspect, wherein the first ultrasonic device vibrates the first die at a first frequency and the second die vibrates the second die at a second frequency.

Aspect 34 is the container manufacturing system of any previous or subsequent aspect, wherein the first frequency is equal to the second frequency.

Aspect 35 is the container manufacturing system of any previous or subsequent aspect, further comprising the container preform.

Aspect 36 is the container manufacturing system of any previous or subsequent aspect, further comprising a spacer partially surrounding the die, wherein the ultrasonic device is disposed between the spacer and the die.

Aspect 37 is a method of forming an aluminum container, comprising: receiving, on a ram, a container preform comprising a base and sidewalls, the base of the container preform engaged with a distal end of the ram; vibrating a die using an ultrasonic device connected to the die, the die having an opening concentrically aligned with the ram and sized and shaped for receiving the container preform; and driving the container preform through the die opening by moving the ram in a linear direction through the die opening.

Aspect 38 is the method of any previous or subsequent aspect, wherein the ultrasonic device vibrates the die at a frequency of from 25 kHZ to 100 kHZ.

Aspect 39 is the method of any previous or subsequent aspect, wherein the ultrasonic device vibrates the die in an axial direction.

Aspect 40 is the method of any previous or subsequent aspect, wherein the ultrasonic device vibrates the die in a radial direction.

Aspect 41 is the method of any previous or subsequent aspect, further comprises retracting the ram through the die opening, wherein the ultrasonic device vibrates the die in a first direction when driving the container preform through the die opening and vibrates the die in a second direction when retracting the ram.

Aspect 42 is the method of any previous or subsequent aspect, wherein the die is a first die and the method further comprises driving the container preform through a second die having a second die opening for receiving the container preform.

Aspect 43 is the method of any previous or subsequent aspect, further comprising vibrating the second die while driving the container preform through the second die.

Aspect 44 is a die for forming an aluminum container, comprising: a body defining a die opening sized and shaped for receiving a container preform in response to the container preform being driven by a ram through the die opening; and an ultrasonic device coupled with the die for causing the die to vibrate while the container preform is being driven through the die opening by the ram.

Aspect 45 is the die of any previous or subsequent aspect, wherein the ultrasonic device causes the die to vibrate after the container preform is being driven through the die opening by the ram.

Aspect 46 is the die of any previous or subsequent aspect, wherein the ultrasonic device causes the die to vibrate in a first direction that comprises a radial direction or an axial direction.

Aspect 47 is the die of any previous or subsequent aspect, wherein the ultrasonic device is a first ultrasonic device and the die further comprises a second ultrasonic device coupled with the die for causing the die to vibrate.

Aspect 48 is the die of any previous or subsequent aspect, wherein the first ultrasonic device causes the die to vibrate in a first direction and the second ultrasonic device causes the die to vibrate in a second direction.

Aspect 49 is the die of any previous or subsequent aspect, wherein the die opening is from 50.95 mm to 76.40 mm.

All patents and publications cited herein are incorporated by reference in their entirety. The foregoing description of the embodiments and examples, including illustrated embodiments and examples, has been presented only for the purpose of illustration and description and is not intended to be exhaustive or limiting to the precise forms disclosed. Numerous modifications, adaptations, and uses thereof will be apparent to those skilled in the art.

What is claimed is:

1. A method of making a metal product, comprising:

applying a first lubricant on a punch side of a sheet metal blank;

applying a second lubricant on a die side of the sheet metal blank;

drawing the sheet metal blank using a punch and a die to form the sheet metal blank into a metal product while controlling one or both of a first coefficient of friction between the punch side of the sheet metal blank or a second coefficient of friction between the die side of the sheet metal blank and the die such that the first coefficient of friction is greater than the second coefficient of friction; and ejecting the metal product from the die while controlling a third coefficient of friction between the metal product and the punch to be less than the first coefficient of friction;

wherein controlling the first coefficient of friction comprises applying a first electric current through the first lubricant or applying the first electric current through the second lubricant, and wherein controlling the third coefficient of friction comprises applying a second electric current through the first lubricant.

2. The method of claim 1, wherein the first electric current has a magnitude of from 0.01 mA to 12 A or wherein the second electric current has a magnitude of from 0.01 mA to 12 A, wherein the first electric current or the second electric current, but not both, has a magnitude of 0 A, wherein the first electric current is applied using a voltage of from 0.05 V to 6 V or wherein the second electric current is applied using a voltage of from 0.05 V to 6 V.

3. The method of claim 1, wherein the first electric current is applied between the punch and the die or between the punch and the sheet metal blank or wherein the second electric current is applied between the punch and the die or between the punch and the metal product.

4. The method of claim 1, wherein the first electric current flows from the punch to the die through at least the first lubricant, from the die to the punch through at least the first lubricant, from the punch to the sheet metal blank through at least the first lubricant, from the sheet metal blank to the punch through at least the first lubricant, from the punch to the die through at least the second lubricant, from the die to the punch through at least the second lubricant, from the die to the sheet metal blank through at least the second lubricant, or from the sheet metal blank to the die through at least the second lubricant.

5. The method of claim 1, wherein the second electric current flows from the punch to the die through at least the first lubricant, from the die to the punch through at least the first lubricant, from the punch to the metal product through at least the first lubricant, or from the metal product to the punch through at least the first lubricant.

6. The method of claim 1, wherein the first lubricant and the second lubricant are different lubricants, wherein the first lubricant and the second lubricant are a same lubricant, wherein the first lubricant comprises an ionic liquid, or wherein the second lubricant comprises one or more of an ionic liquid, an aqueous lubricant, an oil-based lubricant, a wax-based lubricant, a petroleum-based lubricant, or a conductive lubricant.

7. The method of claim 1, wherein the sheet metal blank comprises an aluminum alloy.

8. The method of claim 1, wherein the metal product comprises a metal cup, a redrawn metal cup, or a metal bottle preform.

* * * * *